US008803924B2

(12) United States Patent
Akimoto et al.

(10) Patent No.: US 8,803,924 B2
(45) Date of Patent: Aug. 12, 2014

(54) DISPLAY DEVICE

(75) Inventors: Hajime Akimoto, Kokubunji (JP); Toshihiro Sato, Mobara (JP); Akiharu Takabayashi, Atsugi (JP); Masami Iseki, Yokohama (JP)

(73) Assignees: Japan Display Inc., Tokyo (JP); Canon Kabushiki Kaisha, Tokyo (JP)

( * ) Notice: Subject to any disclaimer, the term of this patent is extended or adjusted under 35 U.S.C. 154(b) by 385 days.

(21) Appl. No.: 13/222,315

(22) Filed: Aug. 31, 2011

(65) Prior Publication Data

US 2012/0056913 A1 Mar. 8, 2012

(30) Foreign Application Priority Data

Sep. 3, 2010 (JP) ..... 2010-198307

(51) Int. Cl.
*G09G 5/10* (2006.01)

(52) U.S. Cl.
USPC ..... 345/690; 345/76; 345/89

(58) Field of Classification Search
USPC ..... 345/76–83, 89–96, 204–215, 690
See application file for complete search history.

(56) References Cited

U.S. PATENT DOCUMENTS

| | | | |
|---|---|---|---|
| 2001/0055828 | A1 | 12/2001 | Kaneko et al. |
| 2003/0189535 | A1 | 10/2003 | Matsumoto et al. |

FOREIGN PATENT DOCUMENTS

| | | |
|---|---|---|
| JP | 2006-208966 | 8/2006 |
| JP | 3877049 | 11/2006 |
| JP | 2007-279738 | 10/2007 |
| JP | 4052865 | 12/2007 |
| JP | 2009-533717 | 9/2009 |
| JP | 2011-158822 | 8/2011 |

OTHER PUBLICATIONS

Partial English translation of Office Action in corresponding Japanese Patent Application No. 2010-198307, dated Apr. 8, 2014.

*Primary Examiner* — Vijay Shankar
(74) *Attorney, Agent, or Firm* — Antonelli, Terry, Stout & Kraus, LLP.

(57) ABSTRACT

A display device includes a plurality of pixels respectively including, a light emitting element, a driving transistor configured to control driving current to the light emitting element, and a storage capacitor configured to be written voltage corresponding to a gradation value on and hold the voltage and configured to apply display voltage depending on the voltage corresponding to the gradation value between a gate and a source of the driving transistor. The display device further includes a stress voltage application unit configured to apply a stress voltage having a voltage value outside a range of a value capable of taking the display voltage between the gate and the source of the driving transistor.

27 Claims, 25 Drawing Sheets

DISPLAY DEVICE

CROSS-REFERENCE TO RELATED APPLICATION

The present application claims priority from Japanese Application JP 2010-198307 filed on Sep. 3, 2011, the content to which is hereby incorporated by reference into this application.

BACKGROUND OF THE INVENTION

1. Field of the Invention

The present invention relates to a display device, particularly, a display device using an organic EL element.

2. Description of the Related Art

FIG. 29 shows each pixel circuit of an organic EL (Electro Luminescence) display of the related art. As shown in FIG. 29, the respective pixel circuits have an organic EL element 201, a driving TFT (Thin Film-Transistor) 202, a capacitor 203, a TFT switch 204, and a TFT switch 205.

Specifically, as shown in FIG. 29, an anode of the organic EL element 201 is connected to a power source Voled via a driving TFT (Thin Film-Transistor) 202, and a cathode thereof is grounded. Furthermore, a signal depending on a display voltage is input to a gate of the driving TFT 202 via the TFT switch 204, and a predetermined voltage is input to the source via the TFT switch 205. The capacitor 203 is connected between the gate and the source of the driving TFT 202.

Next, operations of the respective pixel circuits will be described. The TFT switches 204 and 205 are turned on, and an electric potential difference between the signal voltage and the predetermined voltage is held at both ends of the capacitor 203. After that, by turning the TFT switches 204 and 205 off, the electric potential difference held at both ends of the capacitor 203 is output between the gate and the source of the driving TFT 202. Moreover, the driving TFT 202 causes the organic EL element 201 to emit light by the driving electric current depending on the signal voltage. The pixel circuits of the related art as described above are disclosed in Japanese Patent No. 4052865 or Japanese Patent No. 3877049.

SUMMARY OF THE INVENTION

The pixel circuit of the related art can cause the organic EL elements 201 provided in each pixel to emit light by luminance depending on the signal voltage. However, since the driving TFT 202 is a thin film transistor, there is a problem in that the electric current characteristic is changed over time by the application of the gate voltage. Since the thin film transistor is not constituted by a single crystal, a level becoming a carrier trap is easily created in a channel interface, and the thin film transistor has a portion that is stochastically weak in the intermolecular coupling. Thus, the characteristic change due to the entrance or the exit of the carrier in the level or the cut-off of the intermolecular coupling is easily generated by electric field stress.

FIG. 30 is a diagram that shows a TFT characteristic before and after applying the voltage stress between the gate and the source of an amorphous Si-TFT of n channel. Specifically, FIG. 30 shows the result in which the voltage stress is applied between the gate and the source to actually measure a change in voltage and current properties of the TFT in the state of applying the same voltage between the source and the drain of the TFT. A horizontal axis indicates the voltage between the gate and the source, and a vertical axis indicates the electric current between the source and the drain in the logarithm. Furthermore, a solid line indicates the electric current characteristic before applying the voltage stress, and a dashed line indicates the electric current characteristic after applying the voltage stress.

As shown in FIG. 30, when applying the voltage stress between the gate and the source, a threshold voltage (Vth) of the TFT is shifted from (a) to (b), that is, to the high voltage side. An electric current value of a turn-on region represented by a carrier mobility (μ) drops, and an S value in a sub-threshold region drops.

A change with time of the voltage and current characteristic due to the stress in the driving TFT 202 becomes a kind of burning on the display screen, with the result that the image quality of the display screen is degraded. This is because the driving TFT 202 of the pixel having the high light emitting hysteresis causes the high gate voltage stress hysteresis, and the driving TFT 202 of the pixel having the low light emitting hysteresis causes the low gate voltage stress hysteresis.

At the moment, in the display device using the organic EL element, the degradation of the organic EL element itself is large, and, in the low-temperature polycrystalline Si-TFT used in the volume production, the stress change with time is relatively small, and thus the problem mentioned above is not relatively evident. However, when the life expectancy of the organic EL element itself is relatively enlarged, the problem becomes serious. In the current volume product, a circuit thereof is devised so as to correct a difference in threshold voltages of the low-temperature polycrystalline Si-TFT, but the change with time due to the stress also affects the carrier mobility (μ) or S value without being limited to the threshold voltage Vth.

Further, the stress change with time mentioned above is relatively small in the low-temperature polycrystalline Si-TFT but cannot be ignored in a microcrystal Si-TFT, and becomes extremely increased, for example, in the amorphous Si-TFT, the organic TFT or the like. Furthermore, owing to the significant reduction of the manufacturing cost, the replacement from the low-temperature polycrystalline Si-TFT currently used in the volume product to the microcrystal Si-TFT, amorphous Si-TFT, the organic TFT or the like is expected, in these cases, the burning due to the stress change with time becomes a serious problem.

(1) In view of the above problem, a display device according to one or more embodiments of the present invention includes a plurality of pixels respectively including, a light emitting element, a driving transistor configured to control driving current to the light emitting element, and a storage capacitor configured to be written voltage corresponding to a gradation value on and hold the voltage and configured to apply display voltage depending on the voltage corresponding to the gradation value between a gate and a source of the driving transistor. The display device also includes a stress voltage application unit configured to apply a stress voltage having a voltage value outside a range of a value capable of taking the display voltage between the gate and the source of the driving transistor.

(2) In the display device described in (1), the stress voltage application unit applies one of a high voltage value, which has a voltage value higher than an upper limit value of the range of the value capable of taking the display voltage, and a low voltage value, which has a voltage value lower than a lower limit value of the range of the value capable of taking the display voltage. The display device further includes a relief voltage application unit configured to apply a relief voltage. The relief voltage has a voltage value lower than the high voltage value when applying the high voltage value, and has a voltage value higher than the low voltage value when applying the low voltage value.

(3) In the display device described in (2), the relief voltage is a voltage value within the range of the value capable of taking the display voltage.

(4) In the display device described in (3), the relief voltage has the lower limit value when the stress voltage application unit applies the voltage value higher than the upper limit value of the range of the value capable of taking the display voltage. The relief voltage has the upper limit value when the stress voltage application unit applies the voltage value lower than the lower limit value of the range of the value capable of taking the display voltage.

(5) In the display device described in (2), the relief voltage application unit applies the relief voltage after the stress voltage application unit applies the stress voltage.

(6) In the display device described in (2), the plurality of pixels are arranged in a matrix shape. The display device further includes a display voltage generating unit configured to generate the display voltage, a signal line configured to input the display voltage to each of the plurality of pixels, and a power source line configured to supply each light emitting element with a light emitting electric power. Each of the plurality of pixels further has a pixel switch. The driving transistor is an electric field effect transistor. The storage capacitor is disposed between the gate and the source of the driving transistor. One of the source and the drain of the driving transistor is connected to the power source line, and the other thereof is connected to the light emitting element. The gate of the driving transistor is connected to the signal line via the pixel switch.

(7) In the display device described in (6), the display voltage, stress input voltage corresponding to the stress voltage, and relief input voltage that corresponds to the relief voltage are input to each of the plurality of pixels via the signal line.

(8) In the display device described in (7), the display voltage generating unit further comprises a selection switch. The display voltage generating unit selectively outputs the display voltage, the stress input voltage, or the relief input voltage, via the selection switch.

(9) In the display device described in (7), the display voltage generating unit further includes a selection switch. The display voltage generating unit selectively outputs the stress input voltage or the relief input voltage, via the selection switch.

(10) In the display device described in (7), the stress input voltage is input to each of the plurality of pixels via the power source line.

(11) The display device described in (6) further includes a stress voltage line provided in a vertical direction with respect to the signal line. The stress input voltage and the relief input voltage are input to the plurality of pixels via the stress voltage line.

(12) In the display device described in (6), each of the plurality of pixels further includes a light emitting control switch. The electric field effect transistor is an nMOS. A source terminal of electric field effect transistor is connected to the light emitting element, and a drain terminal thereof is connected to the power source line via the light emitting control switch. When applying the stress voltage to the storage capacitor, the light emitting control switch is fixed in an off-state.

(13) In the display device described in (6), each of the plurality of pixels further includes a light emitting control switch. The electric field effect transistor is an nMOS. The source terminal of the electric field effect transistor is connected to the light emitting element, and the drain terminal thereof is connected to the power source line via the light emitting control switch. When applying the relief voltage to the storage capacitor, the light emitting control switch is fixed in an off-state.

(14) In the display device described in (6), each of the plurality of pixels further includes a light emitting control switch. The electric field effect transistor is an nMOS. The source terminal of the electric field effect transistor is connected to the light emitting element, and the drain terminal thereof is connected to the power source line via the light emitting control switch. When applying the display voltage to the storage capacitor, the light emitting control switch is fixed in an off-state.

(15) In the display device described in (1), each of the plurality of pixels further includes a light emitting control switch. The electric field effect transistor is a pMOS. The source terminal of the electric field effect transistor is connected to the power source line, and the drain terminal thereof is connected to the light emitting element via the light emitting control switch. When applying the stress voltage to the storage capacitor, the light emitting control switch is fixed in an off-state.

(16) In the display device described in (1), each of the plurality of pixels further includes a light emitting control switch. The electric field effect transistor is a pMOS. The source terminal of the electric field effect transistor is connected to the power source line, and the drain terminal thereof is connected to the light emitting element via the light emitting control switch. When applying the relief voltage to the storage capacitor, the light emitting control switch is fixed in an off-state.

(17) In the display device described in (1), each of the plurality of pixels further includes a light emitting control switch. The electric field effect transistor is a pMOS. The source terminal of the electric field effect transistor is connected to the power source line, and the drain terminal thereof is connected to the light emitting element via the light emitting control switch. When applying the display voltage to the storage capacitor, the light emitting control switch is fixed in an off-state.

(18) In the display device described in (6), each of the plurality of pixels further includes a channel switch, and a low voltage wiring to which a predetermined constant voltage is applied. The drain terminal of the electric field effect transistor is connected to the low voltage wiring via the channel switch.

(19) In the display device described in (18), the gate of the channel switch is commonly connected to the gate of the pixel switch. The plurality of pixels are controlled for each line of the plurality of pixels via the channel switch.

(20) In the display device described in (6), each of the plurality of pixels further includes a first channel switch, a second channel switch, and a low voltage wiring to which a predetermined constant voltage is applied. The drain terminal of the electric field effect transistor is connected to the low voltage wiring via the first channel switch. The source terminal is connected to the low voltage wiring via the second channel switch.

(21) In the display device described in (20), the gates of the first and second channel switches are commonly connected to the gate of the pixel switch. The plurality of pixels are controlled for each line of the plurality of pixels via the first and second channel switches.

(22) In the display device described in (18), the low voltage wiring is commonly connected between adjacent pixels among the plurality of pixels.

(23) In the display device described in (18), a terminal of the light emitting element, which is not connected to the electric field effect transistor, is commonly grounded between adjacent pixels among the plurality of pixels. The low voltage wiring is grounded in each of the plurality of pixels.

(24) In the display device described in (6), the source terminal of the electric field effect transistor is connected to one end of the light emitting element. The drain terminal of the electric field effect transistor is connected to the power source line. When the display voltage is applied to the storage capacitor, the voltage of the power source line is the same voltage as the voltage that is applied to the other end of the light emitting element.

(25) In the display device described in (6), the source terminal of the electric field effect transistor is connected to one end of the light emitting element. The drain terminal of the electric field effect transistor is connected to the power source line. When the stress voltage is applied to the storage capacitor, the voltage of the power source line is the same voltage as the voltage that is applied to the other end of the light emitting element.

(26) In the display device described in (6), the source terminal of the electric field effect transistor is connected to one end of the light emitting element. The drain terminal of the electric field effect transistor is connected to the power source line. When the relief voltage is applied to the storage capacitor, the voltage of the power source line is the same voltage as the voltage that is applied to the other end of the light emitting element.

(27) The display device described in (6) collectively writes the stress voltage and the relief voltage on the storage capacitor in the plurality of pixels after writing the display voltage on the storage capacitor in the sequence of line in the plurality of pixels within a period of one frame.

(28) The display device described in (1) further includes a memory configured to store display data corresponding to the display voltage, a display voltage generating unit configured to generate the display voltage from the display data, and a supply device configured to supply electric power for driving the display device.

DETAILED DESCRIPTION OF THE INVENTION

Figure 1:
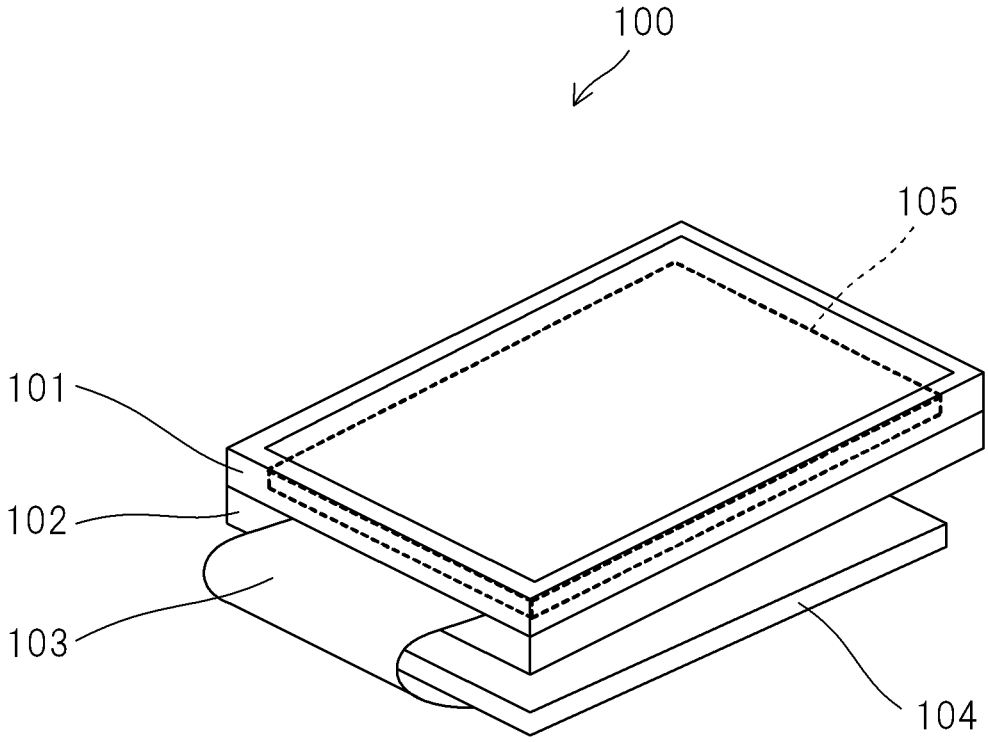
FIG. 1 is a diagram that shows a display device according to a first embodiment of the present invention.

Hereinafter, embodiments of the present invention will be described with reference to the drawings. In addition, in the drawings, the identical or the equivalent elements are denoted by the same reference numerals, and the repeated description will be omitted.

First Embodiment

FIG. 1 is a diagram that shows a display device according to a first embodiment of the present invention. As shown in FIG. 1, an organic EL display device 100 includes an upper frame 101 and a lower frame 102 which are fixed so that a TFT (Thin Film Transistor) substrate 105 having the organic EL panel is interposed therebetween, a circuit board 104 that includes a circuit element creating information to be displayed, and a flexible substrate 103 that sends information of RGB created in the circuit board to the TFT substrate 105.

Figure 2:
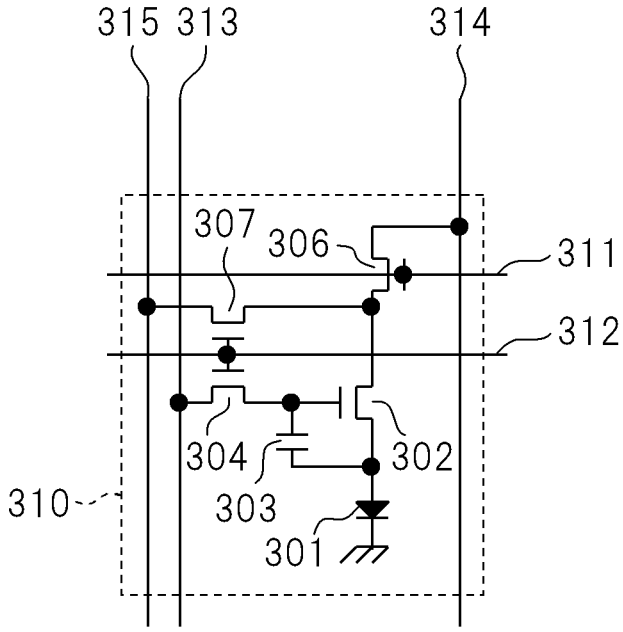
FIG. 2 is a diagram that schematically shows each pixel of the display device in the first embodiment of the present invention.

FIG. 2 is a diagram that schematically shows each pixel of the display device in the first embodiment of the present invention. As shown in FIG. 2, an organic EL element 301 is provided in each pixel 310, an end of the organic EL element 301 is connected to a common cathode electrode, and the other end thereof is connected to a power source line 314 via a driving TFT 302 and a light emitting control switch 306.

A gate of the driving TFT 302 is connected to a signal line 313 via a gate switch 304. A drain of the driving TFT 302 is connected to a low voltage line 315 via a channel switch 307. Furthermore, a storage capacitor 303 is provided between the gate and the source of the driving TFT 302.

A gate of the light emitting control switch 306 is connected to a light emitting control line 311. A source of the light emitting control switch 306 is connected to the power source line 314, and a drain thereof is connected to a drain of the driving TFT 302 and a drain of the channel switch 307.

Gates of the channel switch 307 and the gate switch 304 are connected to a gate scanning line 312. In addition, each switch 307 or the like and the driving TFT 302 are constituted by, for example, amorphous Si-TFT of n channel having the same structure other than the size thereof, and may be provided on a glass substrate.

Figure 3:
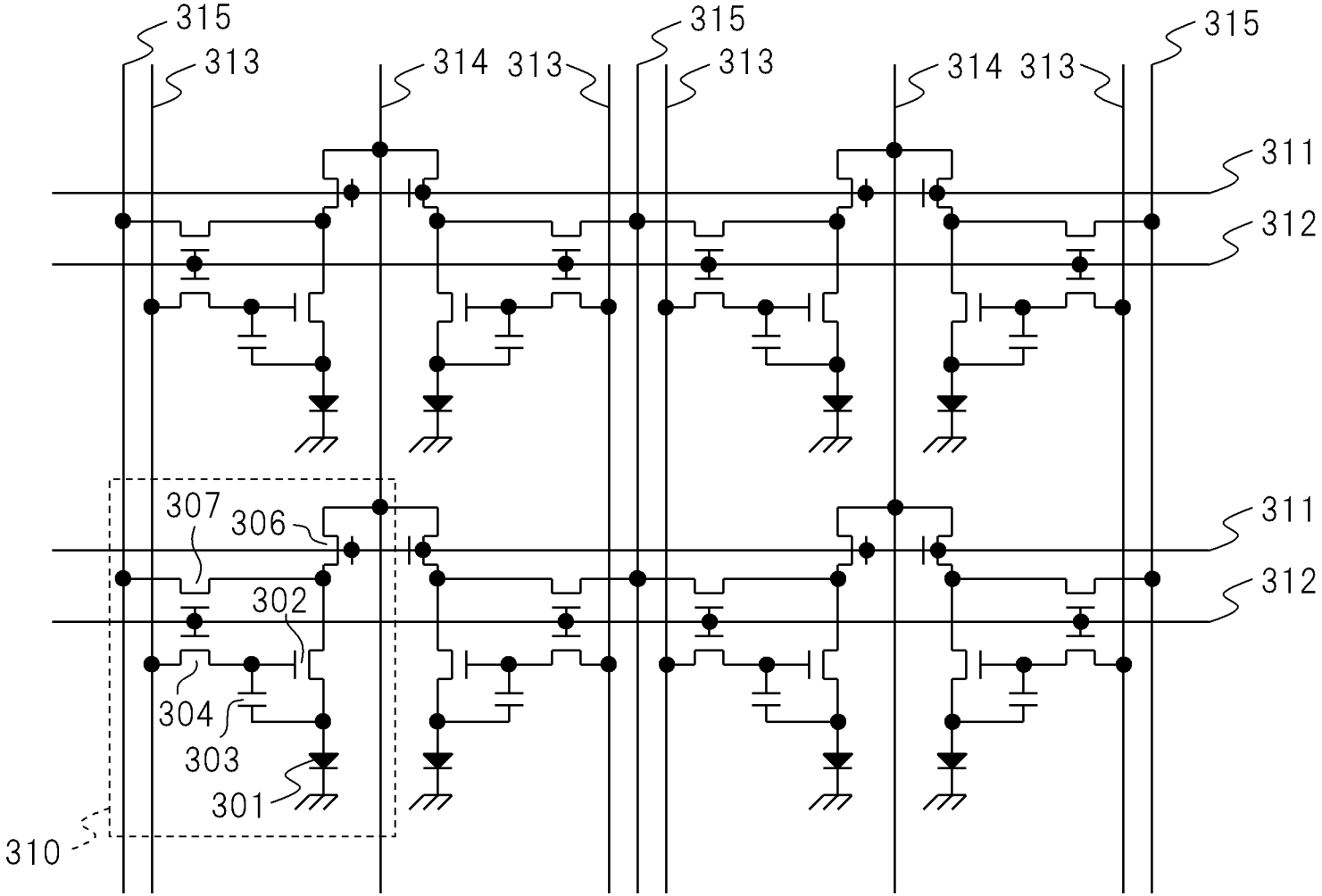
FIG. 3 shows an arrangement diagram of the pixel in the first embodiment of the present invention.

FIG. 3 shows an arrangement diagram of each pixel shown in FIG. 2. As shown in FIG. 3, left and right adjacent pixels 310 share the power source line 314 and the low voltage line 315. Thus, it is possible to simplify the arrangement of the pixels 310, thereby reducing yield in the manufacturing procedure. In addition, although FIG. 3 shows only total eight pixels 310 of horizontal 4 dots and vertical 2 dots for simplicity of explanation, it is needless to say that other numbers of pixels may be disposed as necessary.

Figure 4:
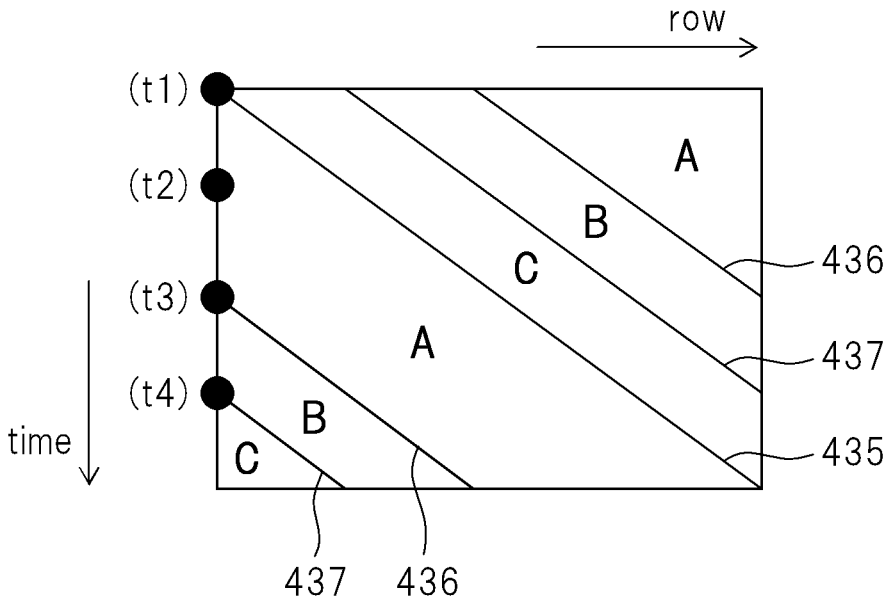
FIG. 4 is a diagram for describing an operation of the pixel in the first embodiment of the present invention.

Next, an outline of an operation of the pixels 310 according to the present embodiment will be described. FIG. 4 is a diagram for describing the operation of the pixels. A horizontal direction of FIG. 4 indicates an array (row) of a vertical direction of each pixel 310 and corresponds to the pixels 310 from a first row to a final row in the horizontal direction. Meanwhile, the vertical direction in FIG. 4 indicates a time axis (time) of each pixel 310, and the length of the vertical direction corresponds to 1 frame period (for example, 1/60 seconds).

Further, a diagonally described solid line indicates a scanning timing of each pixel row. Specifically, a solid line 435 indicates the writing of the display voltage to the storage capacitor 303. Furthermore, a solid line 436 indicates the timing that starts an application of the stress voltage to the driving TFT 302, and a solid line 437 indicates the timing that starts an application of the relief voltage to the driving TFT 302.

The period A of FIG. 4 indicates a light emitting period of the organic EL element 301 by the driving TFT 302, and the period B indicates a stress voltage application period to the driving TFT 302. Furthermore, the period C indicates a relief voltage application period to the driving TFT 302.

For example, a first pixel 310 will be described. Firstly, the writing of the display voltage to the storage capacitor 303 indicated by the solid line 435 is performed, and the subsequent light emitting period A, the organic EL element 301 emits light. In the period B starting in the subsequent solid line 436, the stress voltage is applied to the driving TFT 302. In the period C starting in the subsequent solid line 437, the relief voltage is applied to the driving TFT 302. The operation as described above is repeatedly performed for 1 frame period.

Next, the voltage stress to the driving TFT 302 in the operation as above will be described. FIGS. 5A to 5D and 6A to 6D are diagrams for describing a concept of a characteristic change of the driving TFT due to the gate voltage stress.

Specifically, FIGS. 5A to 5D and 6A to 6D show the characteristic of the driving TFT in the state of applying the same voltage between the source and the drain of the driving TFT. Furthermore, a horizontal axis indicates a voltage between the gate and the source of the driving TFT 302, and a vertical axis indicates a current flowing between the source and the drain of the driving TFT 302 by a logarithm. In addition, FIGS. 5A to 5D and 6A to 6D differ from each other in that the directions of the application of the stress voltage and the relief voltage are opposite, and other points are identical to each other.

Figure 5A:
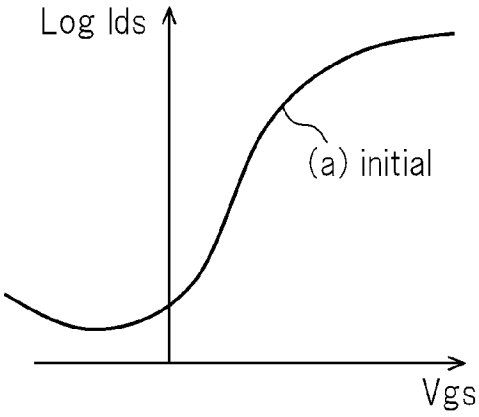
FIG. 5A is a diagram that shows an initial state of a driving TFT in the first embodiment of the present invention.
Figure 5B:
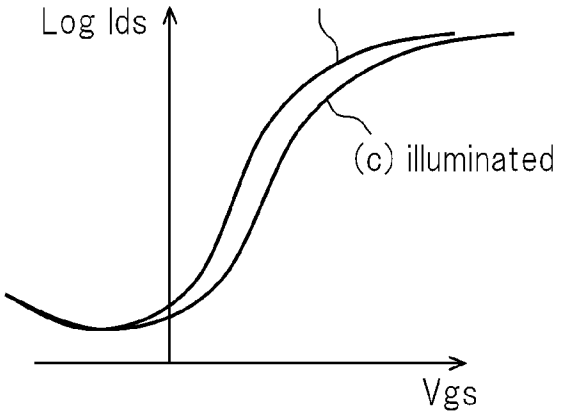
FIG. 5B is a diagram that shows a characteristic of the driving TFT after a light emitting period A in FIG. 4.
Figure 6A:
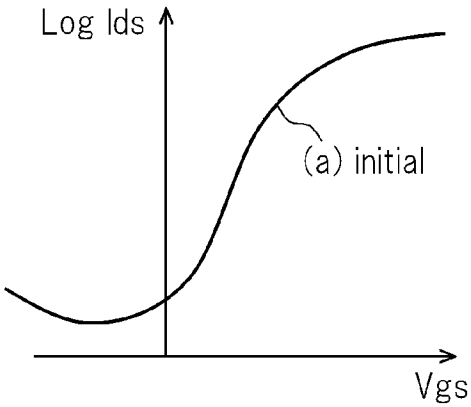
FIG. 6A is a diagram that shows an initial state of the driving TFT.
Figure 6B:
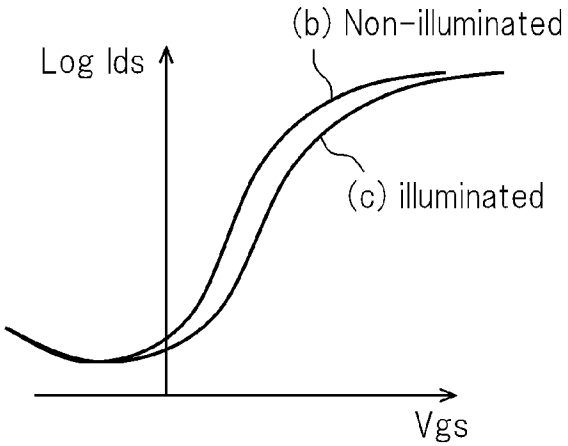
FIG. 6B is a diagram that shows the characteristic of the driving TFT after the light emitting period A in FIG. 4.

FIGS. 5A and 6A are diagrams that show the initial state of the driving TFT. FIGS. 5B and 6B are diagram that show the characteristic of the driving TFT after the light emitting period A in FIG. 4. As shown in FIGS. 5B and 6B, characteristic (c) of the driving TFT 302 that has driven the organic EL element 301 is different from characteristic (b) of the driving TFT 302 which has not driven the organic EL element 301.

This is because, the characteristic (b) of the driving TFT 302 (non-illuminated), which has not driven the organic EL element 301, is the same as (a) initial as shown in FIGS. 5A and 6A because the organic EL element 301 has not driven. On the other hand, the characteristic (c) of the driving TFT 302 (illuminated) that has driven the organic EL element 301 is subjected to a change in characteristic thereof by the change with time due to the gate voltage application mentioned above.

Figure 5C:
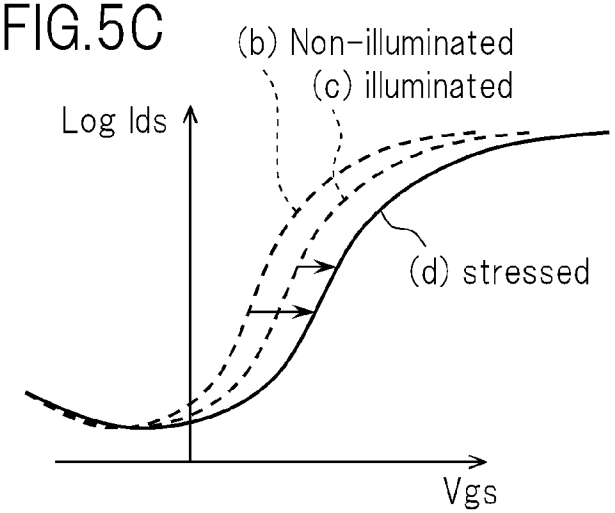
FIG. 5C is a diagram that shows a characteristic of the driving TFT after applying a stress voltage between the gate and the source of the driving TFT at a period B shown in FIG. 4.
Figure 6C:
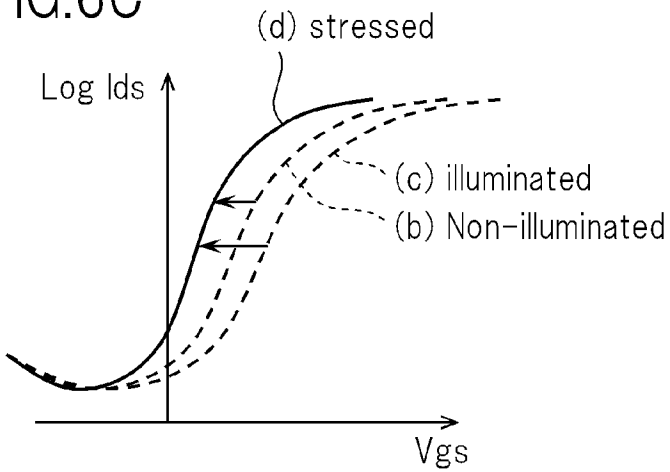
FIG. 6C is a diagram that shows the characteristic of the driving TFT after applying the stress voltage between the gate and the source of the driving TFT at the period B shown in FIG. 4.

FIGS. 5C and 6C are diagrams that show the characteristic of the driving TFT 302 after applying the stress voltage between the gate and the source of the driving TFT at the period B shown in FIG. 4. Herein, the stress voltage has a voltage value outside the range capable of taking the display voltage, and preferably has a voltage value that is sufficiently higher or lower than the voltage value of the range capable of taking the display voltage.

Specifically, for example, the stress voltage has a voltage value sufficiently higher than the voltage giving the characteristic indicated by (c) as shown in FIG. 5C or a voltage sufficiently lower than the voltage giving the characteristic indicated by (b) as shown in FIG. 6C. In other words, the stress voltage has a voltage value excessively higher or lower than the voltage value of the range capable of taking the display voltage.

Figure 5D:
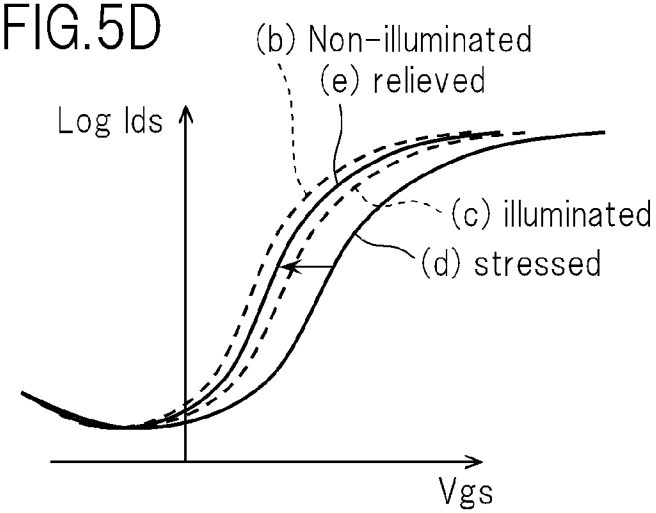
FIG. 5D is a diagram that shows a characteristic of the driving TFT after applying a relief voltage between the gate and the source of the driving TFT at a period C shown in FIG. 4.
Figure 6D:
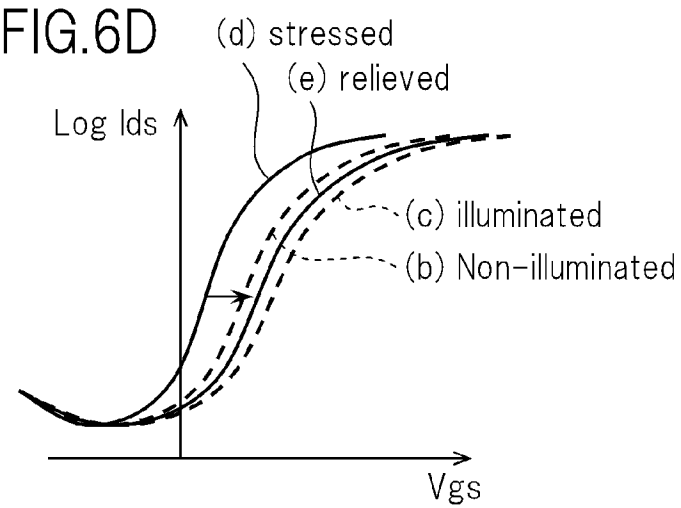
FIG. 6D is a diagram that shows the characteristic of the driving TFT after applying the relief voltage between the gate and the source of the driving TFT at the period C shown in FIG. 4.

FIGS. 5D and 6D are diagrams that show the characteristic of the driving TFT after applying the relief voltage between the gate and the source of the driving TFT at the period C shown in FIG. 4. As shown in FIGS. 5D and 6D, both of the characteristics (c) (illuminated) and (b) (non-illuminated) are changed to the same characteristic (d) (stressed). This is because, since the change with time due to the gate voltage application greatly depends on the gate voltage, the presence or the absence of the stress in the light emitting element driving can be ignored at the period A compared to the gate voltage stress due to the stress voltage.

In this manner, it is possible to solve the burning due to the characteristic change of the driving TFT 302 by applying the stress voltage.

However, as shown in FIG. 5C or 6C, the application of the stress voltage as described above more greatly changes all the characteristics of the driving TFT 302 compared to a case of not applying the stress voltage. Thus, in some cases, a threshold voltage Vth of the driving TFT 302 may be increased, and the current quantity driven to the same display voltage may be considerably decreased. Thus, when it is continued to be driven in this state, the luminance of the display may rapidly declines, and finally, the display device may not emit light.

Thus, at the period C shown in FIG. 4, the relief voltage is applied to the driving TFT 302. Herein, as shown in FIG. 5D, the relief voltage has a voltage value lower than the stress voltage value (a right direction of FIG. 5D), or as shown in FIG. 6D, the relief voltage has a voltage value higher than the stress voltage value (a left direction of FIG. 5D). Preferably, the relief voltage may have a voltage value within the range capable of taking the display voltage. Furthermore, more preferably, the relief voltage may have a minimum voltage value among the voltage values within the range capable of taking the display voltage. That is, polarity of the relief voltage may be opposite to that of the stress voltage.

As a result, as shown in FIGS. 5D and 6D, the characteristic of (d) (stressed) is relieved to (e) (relieved). At this time, the characteristic of (e) (relieved) is about a characteristic between the characteristics of (b) (non-illuminated) and (c) (illuminated) as shown in FIGS. 5D and 6D.

In this manner, it is possible to restore the excessive characteristic change of the driving TFT 302 by the stress voltage by providing the application period of the relief voltage. Consequentially, it is possible to display an image at stable luminance over a long period. In other words, it is possible to uniformly restore the larger characteristic change of the driving TFT 302 by applying the stress voltage and to realize a display device 100 that does not generate the burning or decline in luminance due to the driving circuit.

Figure 7:
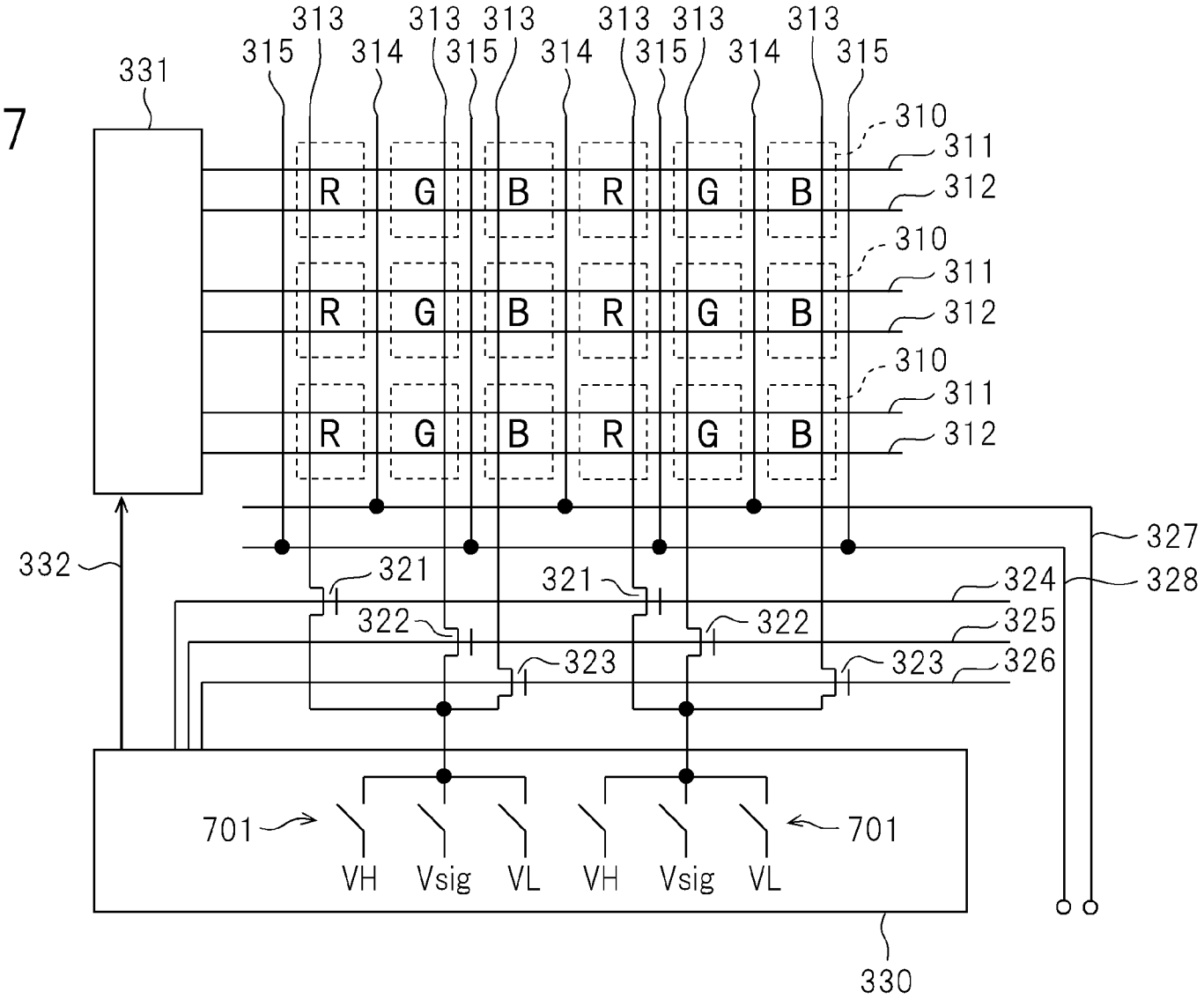
FIG. 7 is a diagram that shows an outlet of a driving circuit in the first embodiment of the present invention.

Next, a driving circuit for applying the stress voltage and the relief voltage as explained above will be described. FIG. 7 shows an outline of the driving circuit in the first embodiment. In addition, FIG. 7 shows only the pixel 310 of 6×3 dots for simplification of the description, but it is needless to say that other numbers of pixels may be used as necessary. Furthermore, it is needless to say that, according to a desired resolution, three color organic EL elements 301 of red (R), green (G), and blue (B) may be provided respectively in the pixels 310 of 3 dots in a horizontal direction, which forms one display unit.

As shown in FIG. 7, one ends of the light emitting control line 311 and the gate scanning line 312 are connected to a vertical scanning circuit 331. Furthermore, as mentioned above, the light emitting control line 311 and the gate scanning line 312 disposed in the horizontal direction are connected to the respective pixels 310.

The power supply line 314 and the low voltage line 315 are connected to a power source input line 327 and a low voltage line input line 328, respectively. Furthermore, for example, 10 V and 0 V are input from an external voltage supply source (not shown) to the power supply input line 327 and the low voltage line input line 328, respectively.

The signal line 313 is connected to a driver IC 330 via switch-over switches 321, 322, and 323 by the corresponding emission colors of RGB. Furthermore, gate scanning lines 324, 325, and 326 of the switch-over switches 321, 322, and 323, and a control line group 332 of the vertical scanning circuit 331 are connected to the driver IC 330.

The driver IC 330 has a plurality of switches 701, input terminals of signal voltage VSig, a high voltage VH, and a low voltage VL are connected to an input side of each switch 701, respectively, and an output side thereof is connected to the switch-over switches 321, 322, and 323. Moreover, the driver IC 330 outputs one of the signal voltage VSig, the high voltage VH, and the low voltage VL to be input to the driver IC 330 to the switch-over switches 321, 322, and 323 by each switch 701. In addition, for example, the signal voltage VSig has a voltage value of 0 to 5 V, the high voltage VH has a voltage value of 7 V, and the low voltage VL has a voltage value of 0 V.

Herein, each switch 321 or the like and the vertical scanning circuit 331 may be constituted by an amorphous Si-TFT of n channel having the same basic structure other than the size, and may be provided on the same glass substrate as the pixel 310. Furthermore, the driver IC 330 is, for example, a Si semiconductor chip, and may be installed on the glass substrate in a COG (Chip-on Glass) manner.

Figure 8:
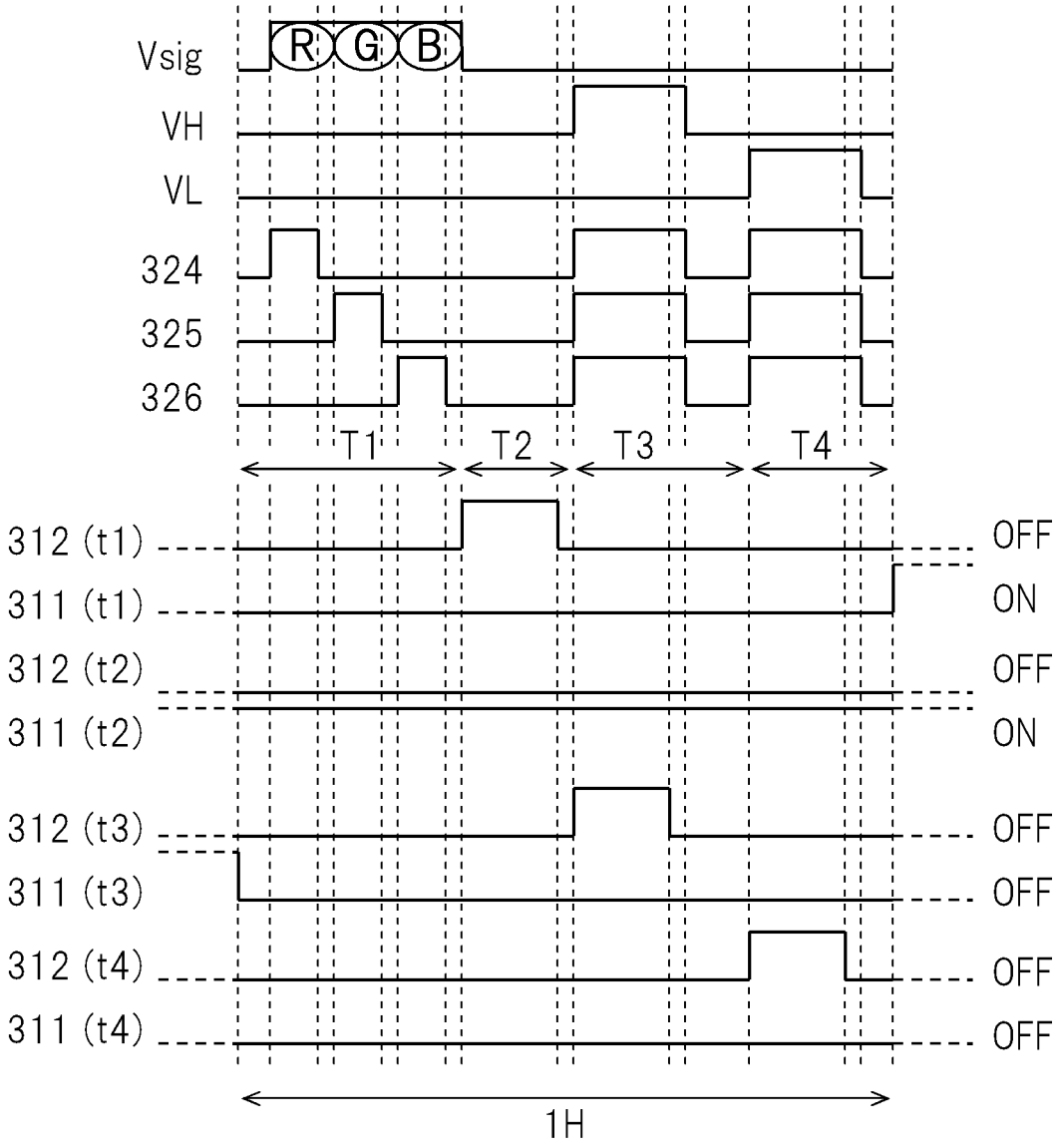
FIG. 8 is an operation timing diagram of the driving circuit in the first embodiment of the present invention.

Next, a specific operation of the driving circuit will be described. FIG. 8 is an operation timing diagram of the driving circuit in the present embodiment. A horizontal direction is a time axis and indicates one Horizontal scanning period (1H). Vsig corresponds to the signal output voltage in the driver IC 330, VH corresponds to the high voltage output in the driver IC 330, and VL indicates the low voltage output in the driver IC 330, 324, 325, and 326 correspond to the outputs of the gate scanning lines 324, 325, and 326. The upside thereof is on and the downside is off, respectively. In addition, Vsig, VH, VL, 324, 325, and 326 are signals that are repeated for each 1H.

Furthermore, a timing diagram of a lower half part of FIG. 8 shows the scanning timing of the light emitting control line 311 and the gate scanning line 312 at the timings t1, t2, t3, and t4. In addition, the timings t1, t2, t3, and t4 correspond to t1, t2, t3, and t4 shown in FIG. 4, and correspond to the operation of the pixel of the first row at the times t1, t2, t3, and t4, respectively.

Hereinafter, as shown in FIG. 8, 1H period is divided into the periods of T1, T2, T3, and T4, and the operation will be sequentially described. As shown in FIG. 8, during one frame period, the gate scanning line 312 is turned on at the beginning of the T2 period at the 1H period, and is turned off at the end of the T2 period. Meanwhile, the light emitting control line 311 is turned on at the end of the T4 period of the 1H period. This state (for example, the state indicated by t2 of FIG. 8) is continued during the period by the timing t3.

After that, at the beginning of T1 period of the timing t3, the light emitting control line 311 is turned off. Meanwhile, the gate scanning line 312 is turned on at the beginning of the T3 period and is turned off at the end thereof. After that, the state is continued to the beginning of the T4 period of the timing t4.

After that, at the beginning of the T4 of the timing t4, the gate scanning line 312 is turned on and is turned off at the end thereof. The operation as described above is repeatedly performed for 1 frame period. Hereinafter, specifically, the operation of the driving circuit and the pixel circuit from each period T1 to T4 will be described.

As shown in FIG. 8, at the period T1 in the 1H period, the signal output voltage is output from the driver IC 330 in the order of RGB and is output to the signal line 313 by switch-over switches 321, 322, and 323 to be scanned by the gate scanning lines 324, 325, and 326. All of the light emitting control line 311 and the gate scanning line 312 are turned off at the timings t1, t3, and t4 as shown in FIG. 4.

At the period T2, the gate scanning line 312 is turned on at the timing t1 so that the gate switch 304 and the channel switch 307 of the pixel are turned on. Here, when the output voltage of the signal line 313 has a certain degree of light emitting signal, the driving TFT 302 is turned on, and 0 V, which is the voltage value of the low voltage line 315, is written on the anode of the organic EL element 301 via the channel switch 307 and the driving TFT 302. Thus, at both ends of the storage capacitor 303, the output voltage of the signal line 313 as the display voltage is written as it is.

Meanwhile, when the output voltage of the signal line 313 nearly does not have the light emitting signal, the driving TFT 302 is not turned on, and thus, the output voltage of the signal line 313 is written at both ends of the storage capacitor 303 by a capacitor division with an inter-terminal capacitor of the organic EL element 301. Herein, since the initial value of the anode voltage of the organic EL element 301 is 0 V and the inter-terminal capacitor of the organic EL element 301 is sufficiently large, the display voltage to be written becomes a value of about 90% of the output voltage of the signal line 313.

At the period T3, the voltage VH (7 V) is output from the driver IC 330, and the voltage VH is output to the signal line 313 via the switch-over switches 321, 322, and 323 that are simultaneously turned on by the gate scanning lines 324, 325, and 326.

Here, at the timing t3, the gate scanning line 312 is turned on so that the gate switch 304 and the channel switch 307 of the pixel are turned on. At this time, because VH (7 V) is written on the gate of the driving TFT 302 from the gate switch 304 via the signal line 313, the driving TFT 302 is turned on, and 0 V, which is the voltage value of the low voltage line 315, is written on the anode of the organic EL element 301 via the channel switch 307 and the driving TFT 302. Thus, at both ends of the storage capacitor 303, instead of the display voltage, VH (7 V) is written as it is.

At the period T4, the voltage VL (0 V) is output from the driver IC 330, and the voltage VL is output to the signal line 313 by the switch-over switches 321, 322, and 323 that are simultaneously turned on by the gate scanning lines 324, 325, and 326. Herein, at the timing t4, the gate scanning line 312 is turned on so that the gate switch 304 and the channel switch 307 of the pixel are turned on.

At this time, because VL (0 V) is written on the gate of the driving TFT 302 from the gate switch 304 via the signal line 313, the driving TFT 302 is turned off, and at both ends of the storage capacitor 303, VL (0 V) is written by the capacitor division with the inter-terminal capacitor of the organic EL element 301.

Herein, because 0 V is written on the anode of the organic EL element 301 at the timing t3 in advance and the inter-terminal capacitor of the organic EL element 301 is sufficiently large, VL (0 V) is written at both ends of the storage capacitor 303 nearly as it is. In addition, as mentioned above, it may be considered that the anode voltage of the organic EL element 301 maintains almost 0 V as it is until reaching the timing t1.

Next, from the viewpoint of the 1 frame period, a specific operation of the driving circuit will be described. At the period A (the light emitting period of the organic EL element 301) from the timing t1 to t3 represented by the timing t2, the light emitting control line 311 is turned on so that the light emitting control switch 306 is fixed in the on-state.

As mentioned above, because the display voltage is written at both ends of the storage capacitor 303 in advance at the timing t1 and the display voltage is applied between the gate and the source of the driving TFT 302, the driving TFT 302 causes the organic EL element 301 to emit light by the current corresponding to the display voltage. In addition, the period A is, for example, about half of 1 frame period.

Next, the light emitting control line 311 is turned off so that the light emitting control switch 306 is turned off, and then, the stress voltage VH (7 V) is written on the storage capacitor 303 provided between the gate and the source of the driving TFT 302 at the timing t3 and is held during period B.

Next, the relief voltage VL (0 V) is written on the storage capacitor 303 provided between the gate and the source of the driving TFT 302 at the timing t4, and then is held during period C. After that, returning to the initial timing t1, a new display voltage is written. The operation as described above is repeated for each 1 frame period.

As mentioned above, according to the present embodiment, it is possible to solve the burning due to the characteristic change of the driving TFT 302 by applying the stress voltage. Further, by providing the application period of the relief voltage, it is possible to restore the excessive characteristic change of the driving TFT 302 due to the stress voltage. Consequentially, it is possible to display an image at the stable luminance over a long period. In other words, it is possible to uniformly restore the characteristic change with respect to the larger characteristic change of the driving TFT 302 due to the stress voltage application, and it is possible to realize a display device which does not generate the burning or decline in luminance due to the driving circuit.

Furthermore, particularly, the driver IC 330 generates the signal line driving voltage including the stress voltage VH (7 V) and the relief voltage VL (0 V) so as to reduce, for example, a size of the TFT circuit that is provided on a glass substrate Thus, the present embodiment can advantageously reduce the frame region and improve the yield rate. Moreover, when the vertical scanning circuit 331 is also formed as an IC chip, the size of TFT circuit can be reduced more effectively so that the present embodiment can more advantageously improve the yield rate. Furthermore, because the anode terminal of the organic EL element 301 is reset to 0 V during the application period of the stress voltage, for example, it is possible to avoid an erroneous light emission of the organic El element 301 due to the jumping of the clock pulse or the like. As a result, it is possible to display an image with extremely high contrast in which a black luminance level does not float.

In addition, the present embodiment may be variously modified within the range not departing from the gist of the present invention. For example, the TFT such as the driving TFT 302 may use an oxide-TFT such as a low-temperature polycrystalline Si-TFT, a microcrystal Si-TFT, an amorphous Si-TFT, an organic Si-TFT, and an IGZO instead of an amorphous Si-TFT. The switch 321 or the like using the nMOS-TFT may use a CMOS switch as necessary. Furthermore, a TFT circuit realizing the driver IC 330 may be provided instead of the driver IC 330, and on the contrary, the switch-over switches 321, 322, and 323 may be included in the driver IC 330.

Further, in the present embodiment, the circuit may be provided on a plastic substrate or another opaque substrate other than the glass substrate. Furthermore, as an array of the pixel 310, other pixel arrays such as RGBW or a delta arrangement other than a RGB stripe arrangement may be used. In the present embodiment, the voltage load is applied to each driving TFT 302 in the order of VSig, VH, and VL, but the voltage load may be applied by changing the order, such as an order, VSig, VL, VH. Moreover, in the present embodiment, the stress voltage VH and the relief voltage VL are 7 V and 0 V, respectively, but it is needless to say that other voltages may be used if the voltages can exhibit the same effect as described above.

Second Embodiment

Figure 9:
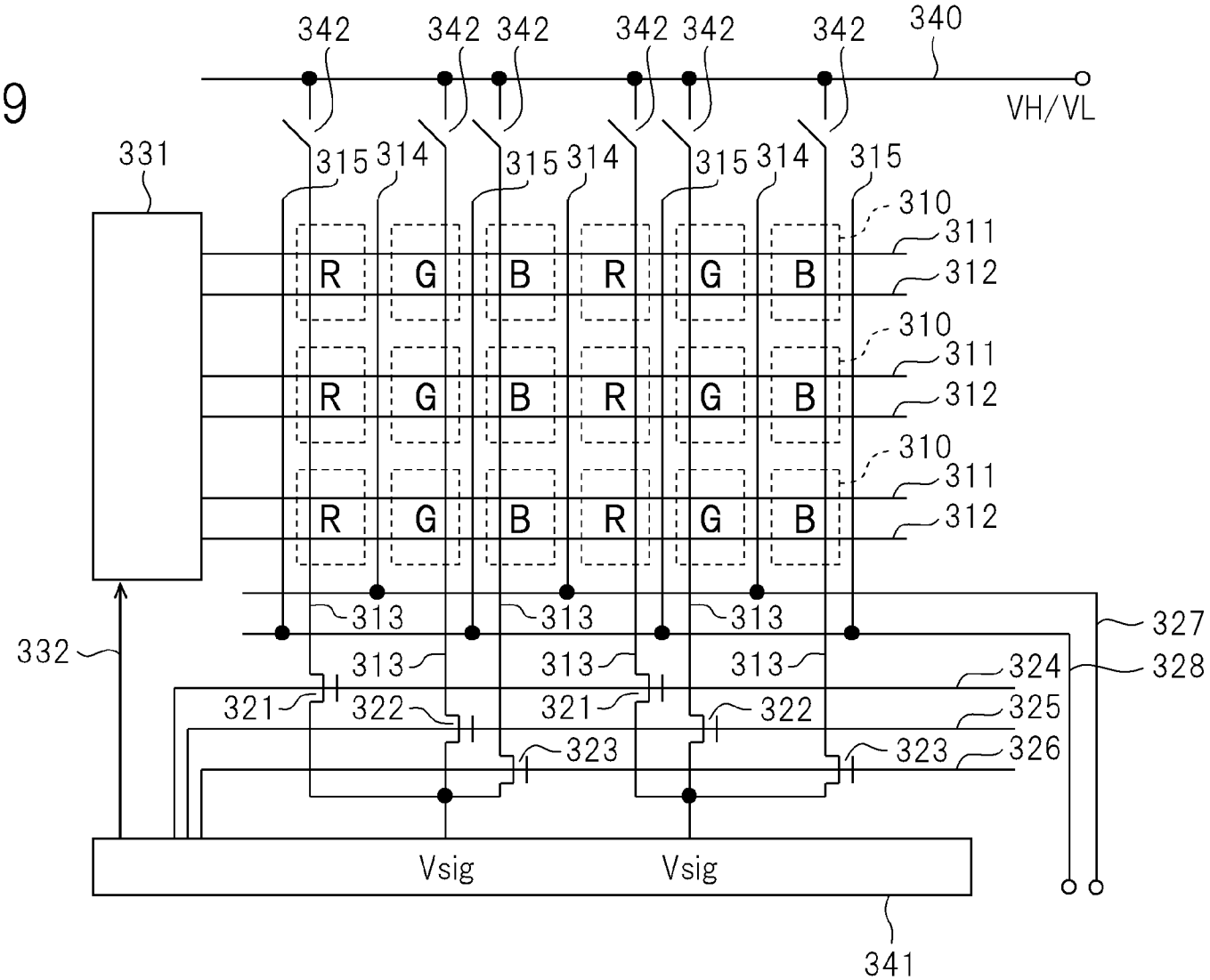
FIG. 9 is a diagram for describing a second embodiment of the present invention.

FIG. 9 is a diagram for describing a second embodiment of the present invention. The second embodiment differs in that the driver IC does not generate the stress voltage VH (7 V) and the relief voltage VL (0 V). Other points are similar to those of the first embodiment, and the descriptions of the similar points will be omitted.

Specifically, unlike FIG. 7 that shows the driving circuit in the first embodiment, as shown in FIG. 9, in a driving circuit in the second embodiment, the signal line 313 is connected to a driver IC 341 via the switch-over switches 321, 322, and 323 by the emission color of the corresponding RGB. Furthermore, a VH/VL input line 340 is provided in the other end of the signal line 313 via a switch 342 for writing the high pressure VH and the low voltage VL on the signal line 313. The high voltage VH or the low voltage VL is output to the VH/VL input line 340. In addition, since a basic operation of the driving circuit in the second embodiment is similar to the operation of the first embodiment, the description thereof will be omitted.

According to the present embodiment, the driver IC 341 may output only the signal voltage Vsig to the signal line 313, and the high voltage output terminal can be limited to the driving terminal of the gate scanning lines 324, 325, and 326 of the switch-over switches 321, 322, and 323, which are the TFT circuits, and the control line group 332 of the vertical scanning circuit 331. Thus, most of the driver IC 341 can be configured as a low voltage-resistant circuit, so that the size of the driver IC 341 and the cost thereof can be reduced.

Further, since the configuration of the driver IC 341 is general, for example, the driver IC 341 used in an existing liquid crystal display device can be used, which can consequentially contribute to a reduction in cost. In addition, the display device in the second embodiment may be used in a mobile phone or the like.

Furthermore, according to the present embodiment, like the first embodiment mentioned above, it is possible to solve the burning due to the characteristic change of the driving TFT 302 by applying the stress voltage. Moreover, by providing the application period of the relief voltage, it is possible to restore the excessive characteristic change of the driving TFT 302 due to the stress voltage. Consequentially, it is possible to display an image at the stable luminance over a long period. In other words, it is possible to uniformly restore the characteristic change with respect to the larger characteristic change of the driving TFT 302 due to the stress voltage application, and it is possible to realize a display device which does not generate the burning or decline in luminance due to the driving circuit.

Third Embodiment

Figure 10:
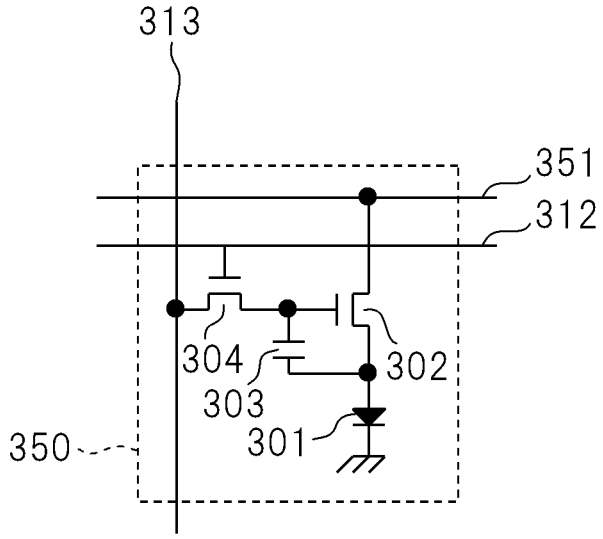
FIG. 10 is a diagram that schematically shows each pixel of the display device in a third embodiment of the present invention.

FIG. 10 is a diagram that schematically shows each pixel of a display device in a third embodiment. As shown in FIG. 10, each pixel 350 has an organic EL element 301. One end of the organic EL element 301 is grounded to a common cathode electrode, and the other end thereof is connected to a power source line 351 via the driving TFT 302.

The storage capacitor 303 is provided between the gate and the source of the driving TFT 302. The gate of the driving TFT 302 is connected to the signal line 313 via the gate switch 304. The gate of the gate switch 304 is connected to the gate scanning line 312.

In addition, the gate switch 304 and the driving TFT 302 may be constituted by the amorphous Si-TFT of n channel having the same basic structure other than the size, and each pixel 350 may be provided on the glass substrate. Furthermore, since the basic operation of each pixel 350 shown in FIG. 10 is similar to the first embodiment, the description thereof will be omitted.

Figure 11:
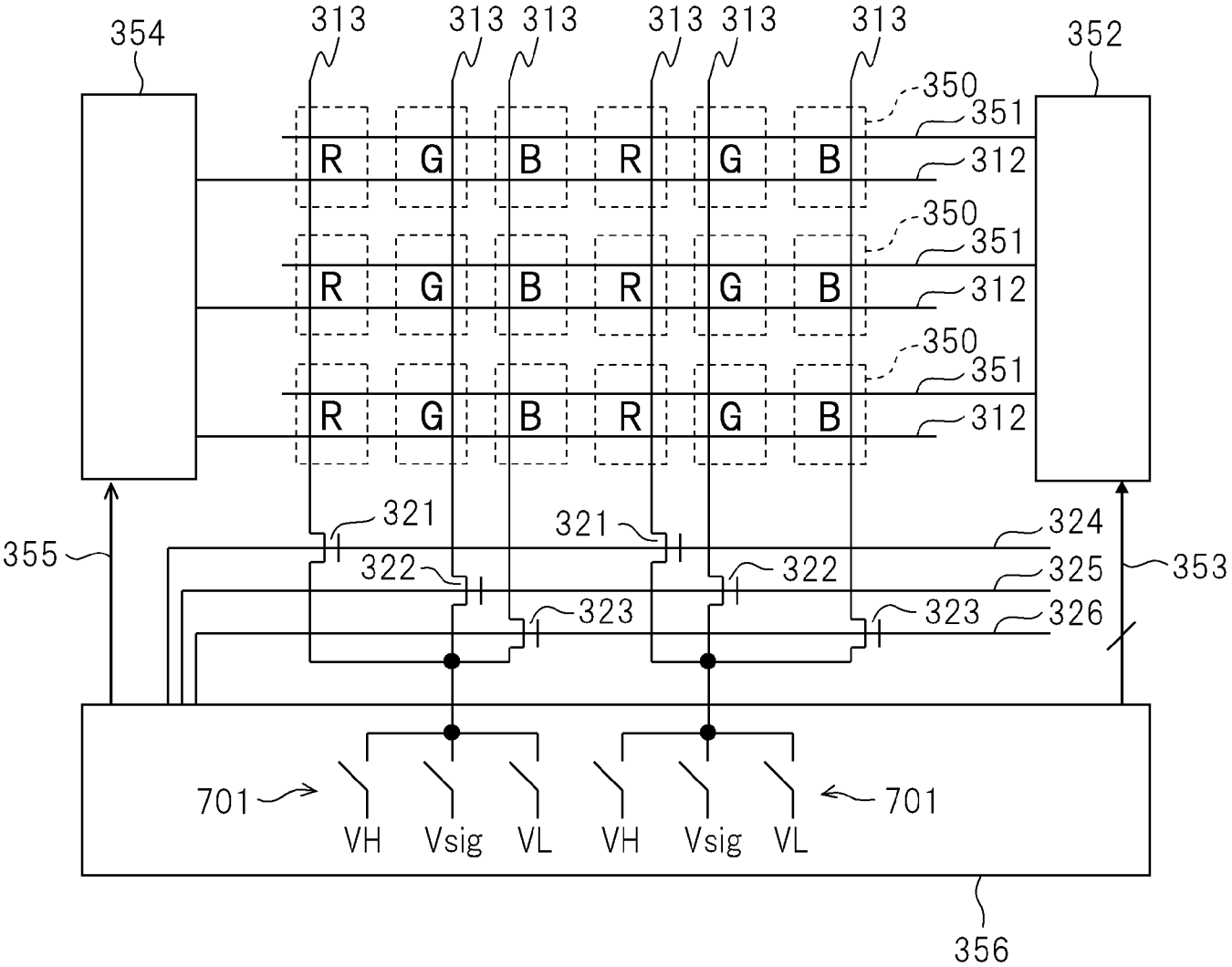
FIG. 11 is a diagram that shows an outline of the driving circuit in the third embodiment of the present invention.

FIG. 11 is a diagram that shows an outline of the driving circuit in the third embodiment. FIG. 11 shows only the pixel 350 of 6×3 dots for the simplification of the description, but it is needless to say that other numbers of pixels may be used as necessary. Furthermore, organic EL elements 301 of three colors of red (R), green (G), and blue (B) may be provided in the pixels of 3 dots in the horizontal direction, which are one display unit, respectively.

As shown in FIG. 11, the gate scanning line 312 and the power source line 351 are connected to the respective pixels 350 in the horizontal direction. One end of the gate scanning line 312 is connected to the vertical scanning circuit 354. One end of the power source line 351 is connected to the power source scanning circuit 352.

The signal line 313 is connected to a driver IC 356 via switch-over switches 321, 322, and 323 by the corresponding emission colors of RGB. Furthermore, gate scanning lines 324, 325, and 326 of the switch-over switches 321, 322, and 323, a control line group 355 of the vertical scanning circuit 354, and the control line group 353 of the power source scanning circuit 352 are connected to the driver IC 356.

Like the first embodiment, the driver IC 356 selectively outputs the signal voltage VSig, the high voltage VH, and the low voltage VL to each signal output terminal. Similarly, for example, the signal voltage VSig has a voltage value of 0 to 5 V, the high voltage VH has a voltage value of 7 V, and the low voltage VL has a voltage value of 0 V. However, it is needless to say that the voltage value of the high voltage VH may be designed to have equal to or greater than 7 V, and the voltage value of the low voltage VL may be designed to have equal to or less than 0 V. In addition, in this case, the voltage-resistant design of the driver IC 356 becomes more complex, but the stability of the driving TFT 302 can be further improved.

As mentioned below, for example, the power source scanning circuit 352 selectively outputs the voltage of 9 V (Voled) and 0 V by a switch (not shown). In addition, each switch 321 or the like and the vertical scanning circuit 354 may be constituted by the amorphous Si-TFT of n channel having the same basic structure other than the size, and may be provided on the same glass substrate as the pixel 350. Furthermore, the driver IC 356 and the power source scanning circuit 352 may be formed as a Si semiconductor chip, and may be installed on the glass substrate in a COG (Chip-on Glass) manner.

Figure 12:
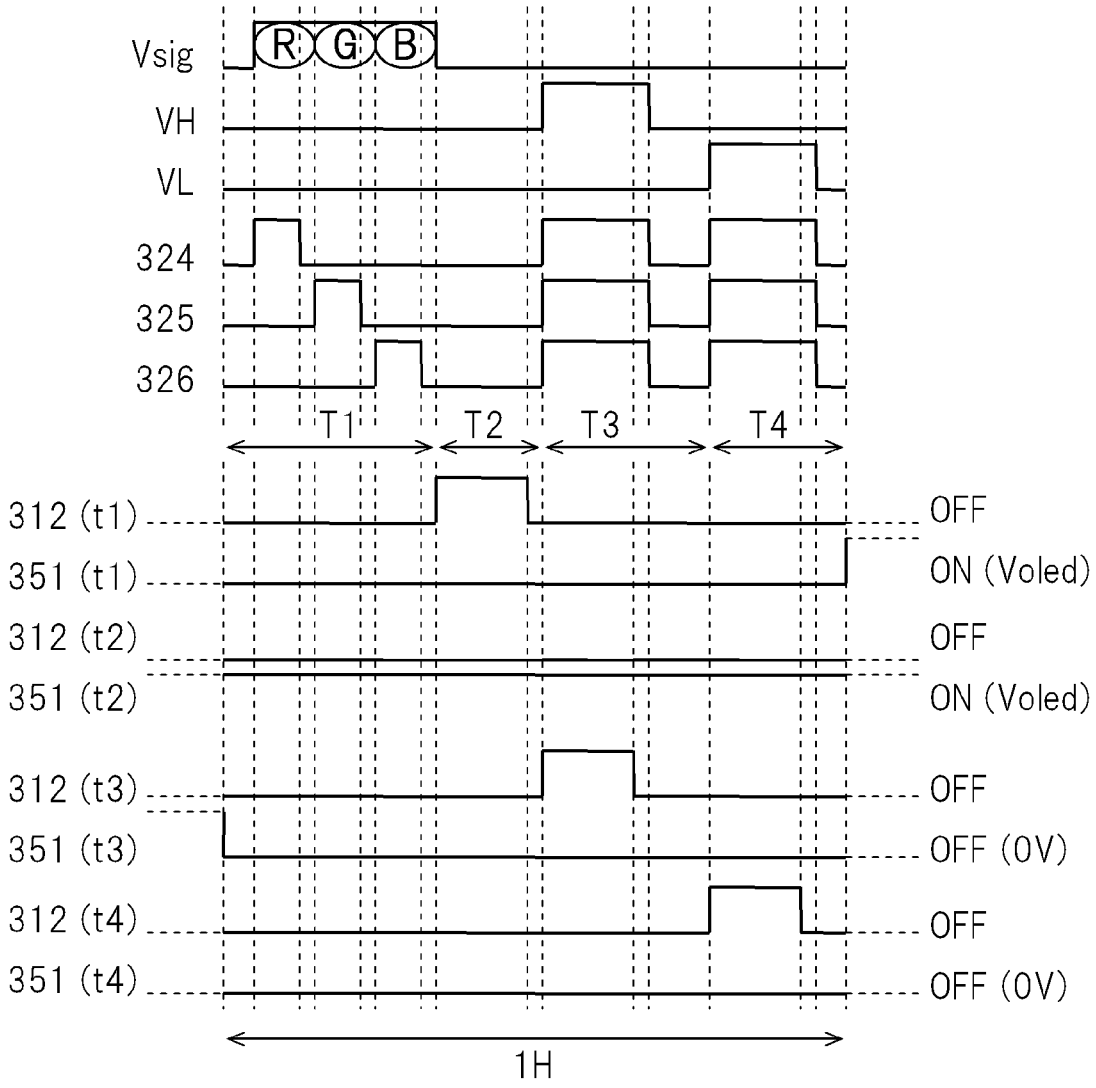
FIG. 12 is an operation timing diagram of the driving circuit in the third embodiment of the present invention.

FIG. 12 is an operation timing diagram of the driving circuit in the third embodiment. In FIG. 12, a horizontal direction indicates a time axis and indicates 1 Horizontal scanning period (1H). Vsig corresponds to the output voltage of the signal line 313 in the driver IC 356, VH corresponds to the high voltage output in the driver IC 356, and VL indicates the low voltage output in the driver IC 356. 324, 325, and 326 correspond to the gate scanning lines 324, 325, and 326. The upside is on and the downside is off, respectively. In addition, Vsig, VH, VL, 324, 325, and 326 are signals that are repeated for each 1H.

A timing diagram of a lower half part shows the scanning timings of the gate scanning lines 312 and the power source line 351 relating to the timings t1, t2, t3, and t4 shown in FIG. 4. The respective timings t1, t2, t3, and t4 are the same as those of the first embodiment.

Next, 1H period shown in FIG. 12 is divided into each period of T1, T2, T3, and T4, and the operation will be sequentially described.

At the period T1, the output voltage of the signal line 313 is output from the driver IC 356 in the order of RGB and is output to the signal line 313 by the switch-over switches 321, 322, and 323 to be scanned by the gate scanning lines 324, 325, and 326. At the timings t1, t3, and t4, the gate scanning line 312 is turned off, and 0 V is applied to the power source line 351.

At the period T2, the gate scanning line 312 is turned on at the timing t1 so that the gate switch 304 of the pixel is turned on. Herein, when the output voltage of the signal line 313 has a certain degree of light emitting signal, the driving TFT 302 is turned on, and 0 V, which is the voltage of the power source line 351, is written on the anode of the organic EL element 301 via the driving TFT 302. Thus, at both ends of the storage capacitor 303, the output voltage of the signal line 313 as the display voltage is written as it is.

Meanwhile, when the output voltage of the signal line 313 nearly does not have the light emitting signal, the driving TFT 302 is not turned on, and thus, the output voltage of the signal line 313 is written at both ends of the storage capacitor 303 by a capacitor division with an inter-terminal capacitor of the organic EL element 301. However, as mentioned below, since the initial value of the anode voltage of the organic EL element 301 is 0 V and the inter-terminal capacitor of the organic EL element 301 is sufficiently large, the display voltage to be written becomes a value of about 90% of the output voltage of the signal line 313.

At the period T3, the voltage VH (7 V) is output from the driver IC 356, and the voltage VH is output to the signal line 313 via the switch-over switches 321, 322, and 323 that are simultaneously turned on by the gate scanning lines 324, 325, and 326. The gate scanning line 312 is turned on at the timing t3 so that the gate switch 304 of the pixel is turned on. Thus, VH (7 V) is written on the gate of the driving TFT 302 from the gate switch 304 via the signal line 313. Thus, the driving TFT 302 is turned on, and, for example, 0 V, which is the voltage of the power source line 351, is written on the anode of the organic EL element 301 via the driving TFT 302. Thus, at both ends of the storage capacitor 303, instead of the display voltage, VH (7 V) is written as it is.

At the period T4, the voltage VL (0 V) is output from the driver IC 356, and the voltage VL is output to the signal line 313 by the switch-over switches 321, 322, and 323 that are simultaneously turned on by the gate scanning lines 324, 325, and 326. At the timing t4, the gate scanning line 312 is turned on, and thus, the gate switch 304 of the pixel is turned on. Thus, since VL (0 V) is written on the gate of the driving TFT 302 from the gate switch 304 via the signal line 313, the driving TFT 302 is turned off. Thus, at both ends of the storage capacitor 303, VL (0 V) is written by the capacitor division with the inter-terminal capacitor of the organic EL element 301.

At this time, because 0 V is written on the anode of the organic EL element 301 at the timing t3 in advance and the inter-terminal capacitor of the organic EL element 301 is sufficiently large, VL (0 V) is written at both ends of the storage capacitor 303 nearly as it is. In addition, as mentioned above, it may be considered that the anode voltage of the organic EL element 301 maintains almost 0 V as it is until reaching the timing t1.

Next, from the viewpoint of the 1 frame period, a specific operation of the driving circuit will be described. At the period A (the light emitting period of the organic EL element 301) from the timings t1 to t3 represented by the timing t2, the power supply line 351 is turned on (for example, Voled, 9 V).

The display voltage is written at both ends of the storage capacitor 303 in advance at the timing t1 and the display voltage is applied between the gate and the source of the driving TFT 302. Thus, the driving TFT 302 drives the organic EL element 301 to emit light by the current corresponding to the display voltage. In addition, the period A is, for example, about half of 1 frame.

Next, the power source line 351 is turned off (outputs 0 V), whereby the light emitting period is finished, and the stress voltage VH (7 V) is written on the storage capacitor 303 provided between the gate and the source of the driving TFT 302 at the timing t3 and is held during period B.

Next, the relief voltage VL (0 V) is written on the storage capacitor 303 provided between the gate and the source of the driving TFT 302 at the timing t4, and is held during period C. After that, returning to the initial timing t1, a new display voltage is written. The operation as described above is repeated for each 1 frame period.

As mentioned above, according to the present embodiment, because the circuit of the pixel 350 can be constituted by two TFTs, the present embodiment is extremely advantageous in the high precision and an improvement in yield. Furthermore, upon manufacturing a large panel, since the yield of the TFT is very important, the display device of the present embodiment can be effectively applied to the large panel. In addition, in that case, in some cases, the load capacitor of each gate line or signal line may be increased. Thus, in order to ensure the driving ability, it is also desirable to configure the vertical scanning circuit 354 by the IC chip, and it is desirable not to provide the switch-over switches 321, 322, and 323.

Moreover, like the first embodiment, according to the present embodiment, it is possible to solve the burning due to the characteristic change of the driving TFT 302 by applying the stress voltage. Furthermore, by providing the application period of the relief voltage, it is possible to restore the excessive characteristic change of the driving TFT 302 due to the stress voltage. Consequentially, it is possible to display an image at the stable luminance over a long period. In other words, it is possible to uniformly restore the characteristic change with respect to the larger characteristic change of the driving TFT 302 due to the stress voltage application, and it is possible to realize a display device which does not generate the burning or decline in luminance due to the driving circuit.

Fourth Embodiment

Figure 13:
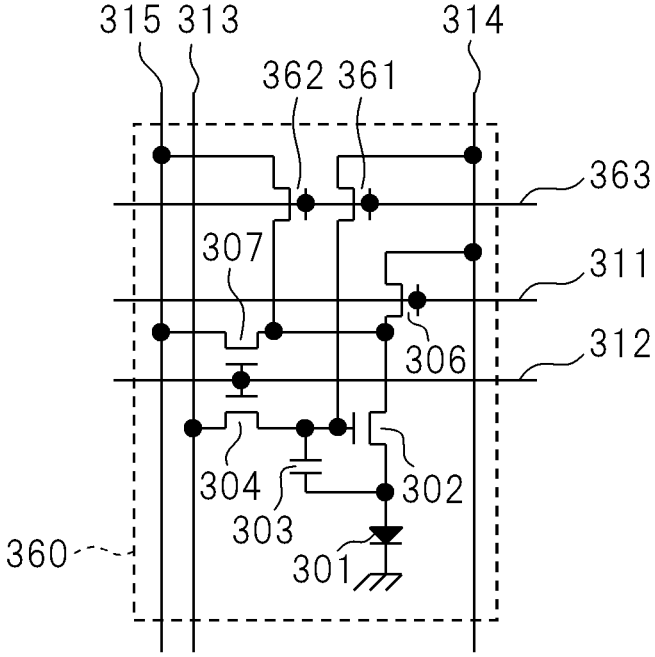
FIG. 13 is a diagram that schematically shows each pixel of the display device in a fourth embodiment of the present invention.

FIG. 13 is a diagram that schematically shows each pixel of a display device in a fourth embodiment. As shown in FIG. 13, each pixel 360 has an organic EL element 301. One end of the organic EL element 301 is grounded to a common cathode electrode, and the other end thereof is connected to the power source line 314 via the driving TFT 302 and the light emitting control switch 306.

The storage capacitor 303 is provided between the gate and the source of the driving TFT 302. The gate of the driving TFT 302 is connected to the signal line 313 via the gate switch 304, and the drain of the driving TFT 302 is connected to the low voltage line 315 via the channel switch 307. Furthermore, the gate of the driving TFT 302 is connected to the power source line 314 via the second gate switch 361, and the drain of the driving TFT 302 is connected to the low voltage line 315 via the second channel switch 362.

The gate of the light emitting control switch 306 is connected to the light emitting control line 311, and the gates of the gate switch 304 and the channel switch 307 are connected to the gate scanning line 312. The gates of the second gate switch 361 and the second channel switch 362 are connected to the second gate scanning line 363.

In addition, each switch 321 or the like and the driving TFT 302 may be constituted by the amorphous Si-TFT of n channel having the same basic structure other than the size, and each pixel 360 may be provided on the glass substrate. Furthermore, since the basic operation of each pixel shown in FIG. 13 is similar to the first embodiment, the description thereof will be omitted.

Figure 14:
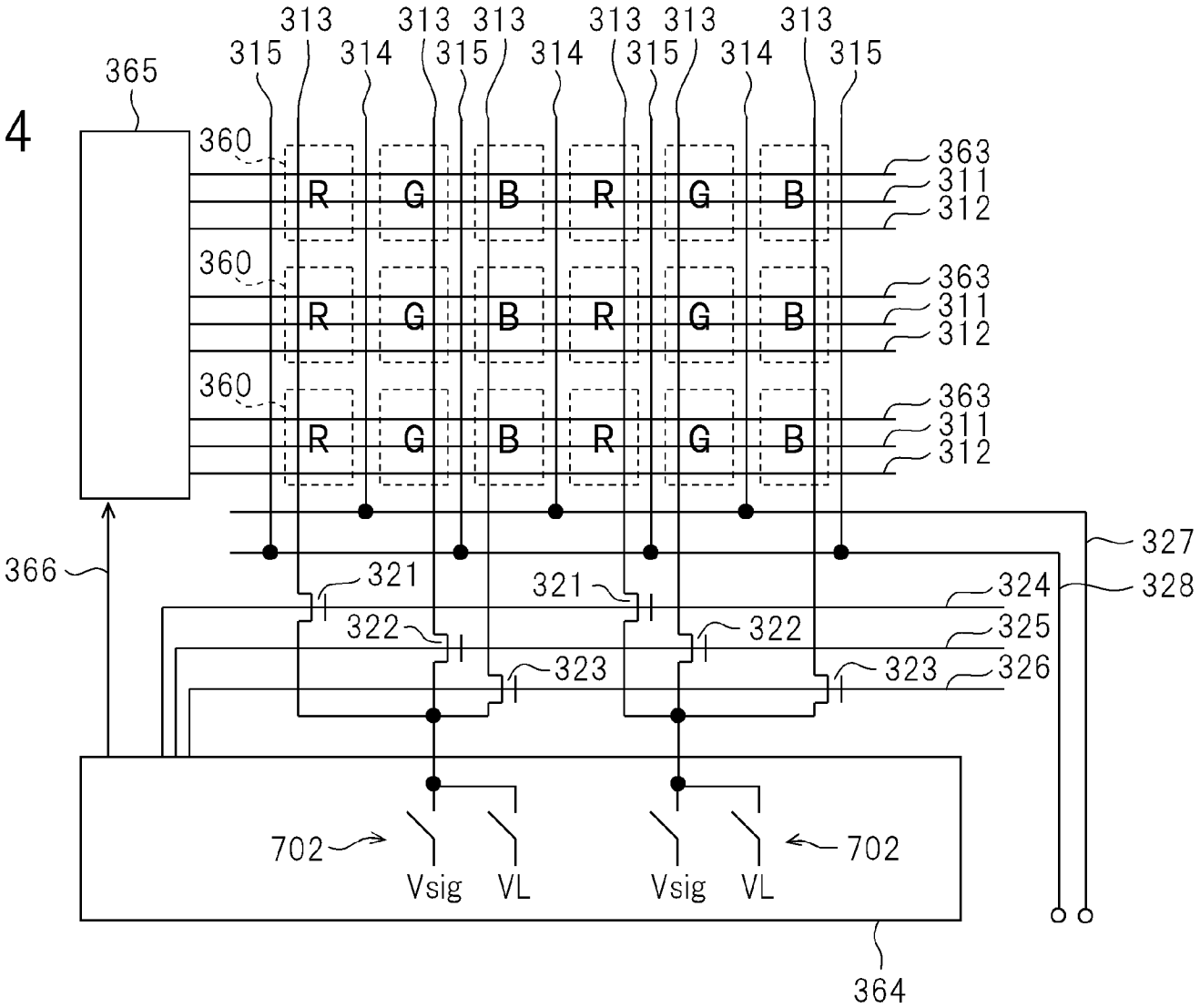
FIG. 14 is a diagram that shows an outline of the driving circuit in the fourth embodiment of the present invention.

FIG. 14 is a diagram that shows an outline of the driving circuit in the fourth embodiment. FIG. 14 shows only the pixel 360 of 6×3 dots for the simplification of the description, but it is needless to say that other numbers of pixels may be used as necessary.

As shown in FIG. 14, the light emitting control line 311, the gate scanning line 312, and the second gate scanning line 363 are connected to the pixel 360 in the horizontal direction. Furthermore, one ends of the light emitting control line 311, the gate scanning line 312, and the second gate scanning line 363 are connected to a vertical scanning circuit 365.

The power source line 314 and the low voltage line 315 are connected to the power source input line 327 and the low voltage line input line 328 at one ends thereof, respectively, and, for example, 10 V and 0 V are input from the outside, respectively. The signal line 313 is connected to a driver IC 364 via switch-over switches 321, 322, and 323 by the corresponding emission colors of RGB.

The gate scanning lines 324, 325, and 326 of the switch-over switches 321, 322, and 323 and the control line group 366 of the vertical scanning circuit 365 are connected to the driver IC 364. The driver IC 364 selectively outputs the signal voltage VSig and the low voltage VL to each signal output terminal via a switch 702. In addition, for example, the signal voltage VSig has a voltage value of 0 to 5 V, and the low voltage VL has a voltage value of 0 V.

In addition, each switch-over switch 321 or the like and the vertical scanning circuit 365 may be constituted by the amorphous Si-TFT of n channel having the same basic structure other than the size, and may be provided on the same glass substrate as the pixel 360. Furthermore, the driver IC 364 may be formed as a Si semiconductor chip, and may be installed on the glass substrate in a COG (Chip-on Glass) manner.

Figure 15:
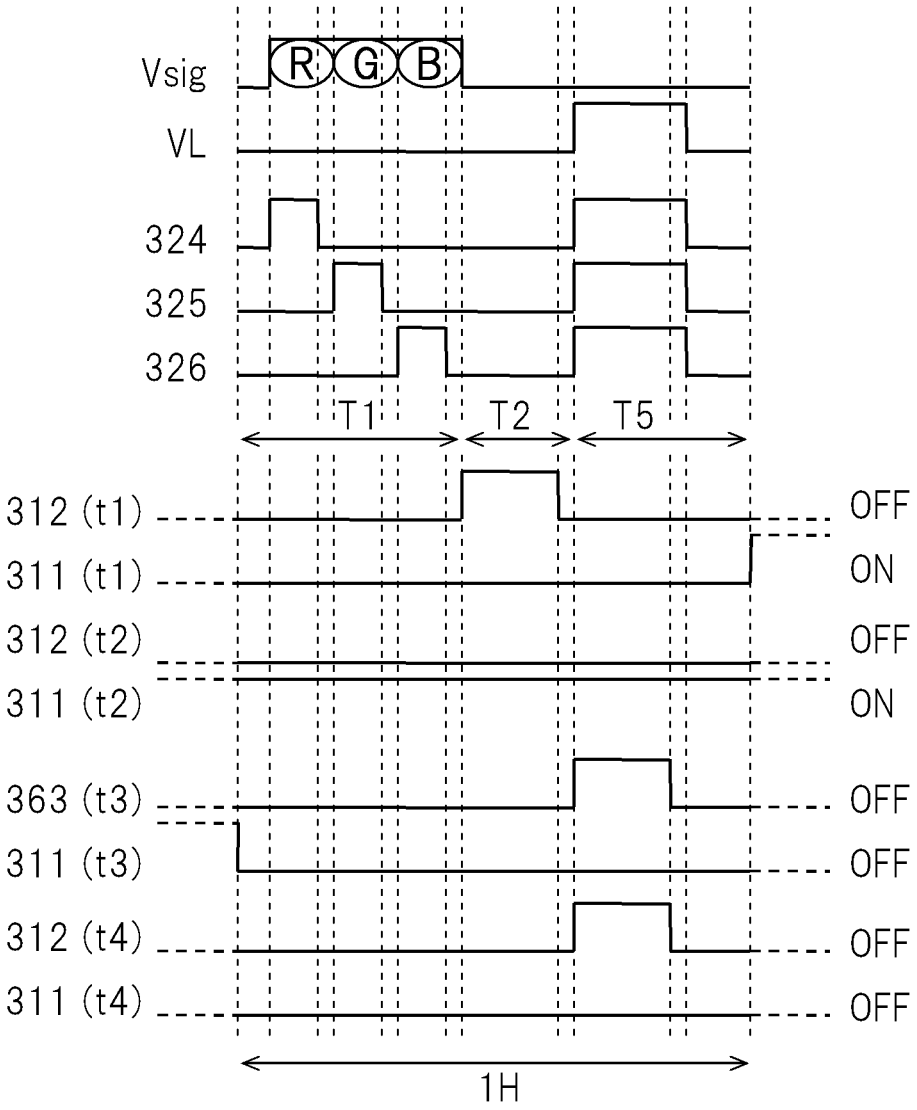
FIG. 15 is an operation timing diagram of the driving circuit in the fourth embodiment of the present invention.

FIG. 15 is an operation timing diagram of the driving circuit in the fourth embodiment. A horizontal direction indicates a time axis and indicates 1 Horizontal scanning period (1H). Vsig corresponds to the output voltage of the signal line 313 in the driver IC 364, and VL indicates the low voltage output in the driver IC 364. 324, 325, and 326 correspond to the gate scanning lines 324, 325, and 326, and the upside is on and the downside is off, respectively. In addition, Vsig, VL, 324, 325, and 326 are signals that are repeated for each 1H.

A timing diagram of a lower half part shows the scanning timings of the light emitting control line 311, the gate scanning lines 312, and the second gate scanning line 363 relating to the timings t1, t2, t3, and t4 of FIG. 4. Herein, the timings t1, t2, t3, and t4 are the same as those shown in FIG. 4 and correspond to the operation of the first pixel at the times t1, t2, t3, and t4, respectively.

Next, as shown in FIG. 15, 1H period is divided into periods of T1, T2, and T5, and the operation will be sequentially described.

At the period T1, the output voltage of the signal line 313 is output from the driver IC 364 in the order of RGB and is output to the signal line 313 by the switch-over switches 321, 322, and 323 that are scanned by the gate scanning lines 324, 325, and 326. At this period, all of the light emitting control line 311, the gate scanning line 312, and the second gate scanning line 363 are turned off at the timings t1, t3, and t4.

At the period T2, the gate scanning line 312 is turned on at the timing t1 so that the gate switch 304 and the channel switch 307 of the pixel 360 are turned on. Herein, when the output voltage of the signal line 313 has a certain degree of light emitting signal, the driving TFT 302 is turned on, and 0 V, which is the voltage of low voltage line 315, is written on the anode of the organic EL element 301 via the channel switch 307 and the driving TFT 302. Thus, at both ends of the storage capacitor 303, the output voltage of the signal line 313 as the display voltage is written as it is.

Meanwhile, when the output voltage of the signal line 313 nearly does not have the light emitting signal, the driving TFT 302 is not turned on, and thus, the output voltage of the signal line 313 is written at both ends of the storage capacitor 303 by a capacitor division with an inter-terminal capacitor of the organic EL element 301. However, as mentioned below, since the initial value of the anode voltage of the organic EL element 301 is 0 V and the inter-terminal capacitor of the organic EL element 301 is sufficiently large, the display voltage to be written becomes a value of about 90% of the output voltage of the signal line 313.

At the period T5, the voltage VL (0 V) is output from the driver IC 364, and the voltage VL is output to the signal line 313 via the switch-over switches 321, 322, and 323 that are simultaneously turned on by the gate scanning lines 324, 325, and 326. Herein, in the pixel 360 equivalent to the timing t3, the second gate scanning line 363 is turned on so that the second gate switch 361 and the second channel switch 362 of the pixel 360 are turned on. At this time, because the power source voltage (VH=Voled=10 V) is written on the gate of the driving TFT 302 from the power source line 314 via the second gate switch 361, the driving TFT 302 is turned on, and 0 V, which is the voltage of low voltage line 315, is written on the anode of the organic EL element 301 via the second channel switch 362 and the driving TFT 302. Thus, at both ends of the storage capacitor 303, instead of the display voltage, the power source voltage (VH=Voled=10 V) is written as it is.

At the horizontal scanning timing, simultaneously, in the pixel equivalent to the timing t4, the gate scanning line 312 is turned on so that the gate switch 304 and the channel switch 307 of the pixel are turned on. Herein, because VL (0 V) is written on the gate of the driving TFT 302 from the gate switch 304 via the signal line 313, the driving TFT 302 is turned off. Thus, at both ends of the storage capacitor 303, VL (0 V) is written by the capacitor division with the inter-terminal capacitor of the organic EL element 301.

At this time, because 0 V is written on the anode of the organic EL element 301 in advance at the timing t3 and the inter-terminal capacitor of the organic EL element 301 is sufficiently large, VL (0 V) is written at both ends of the storage capacitor 303 nearly as it is. In addition, as mentioned above, it may be considered that the anode voltage of the organic EL element 301 maintains almost 0 V as it is until reaching the timing t1.

Next, from the viewpoint of the 1 frame period, a specific operation of the driving circuit will be described. During the period A (the light emitting period of the organic EL element 301) represented by the timing t2, the light emitting control line 311 is turned on so that the light emitting control switch 306 is fixed in the on-state. Because the display voltage is written at both ends of the storage capacitor 303 in advance at the timing t1 and because the display voltage is applied between the gate and the source of the driving TFT 302, the driving TFT 302 drives the organic EL element 301 to emit light by the current corresponding to the display voltage. In addition, the period A is, for example, about half of 1 frame.

Next, the light emitting control line 311 is turned off so that the light emitting control switch 306 is turned off. Then, the stress voltage VH (VH=Voled=10 V) is written on the storage capacitor 303 provided between the gate and the source of the driving TFT 302 at the timing t3 and is held during period B.

Next, the relief voltage VL (0 V) is written on the storage capacitor 303 provided between the gate and the source of the driving TFT 302 at the timing t4, and is held during period C. After that, after 1 frame period, returning to the initial timing t1, a new display voltage is written.

In the present embodiment, the driver IC 364 does not need to output the stress voltage VH (7 V) to the signal line 313. Thus, the high voltage output terminal is limited to the driving terminal of the gate scanning lines 324, 325, and 326 of the switch-over switches 321, 322, and 323, which are the TFT circuits, and the control line group 366 of the vertical scanning circuit 365. Consequentially, most of the driver IC 364 can be formed by the low voltage-resistant circuit so that the size and the const of the driver IC 364 can be reduced. Furthermore, the existing liquid crystal display driver IC 341 may be used as the driver IC 364 so that the cost can be reduced.

Furthermore, like the first embodiment, according to the present embodiment, it is possible to solve the burning due to the characteristic change of the driving TFT 302 by the applying the stress voltage. Furthermore, by providing the application period of the relief voltage, it is possible to restore the excessive characteristic change of the driving TFT 302 due to the stress voltage. Consequentially, it is possible to display an image at the stable luminance over a long period. In other words, it is possible to uniformly restore the characteristic change with respect to the larger characteristic change of the driving TFT 302 due to the stress voltage application, and it is possible to realize a display device which does not generate the burning or decline in luminance due to the driving circuit.

Fifth Embodiment

Figure 16:
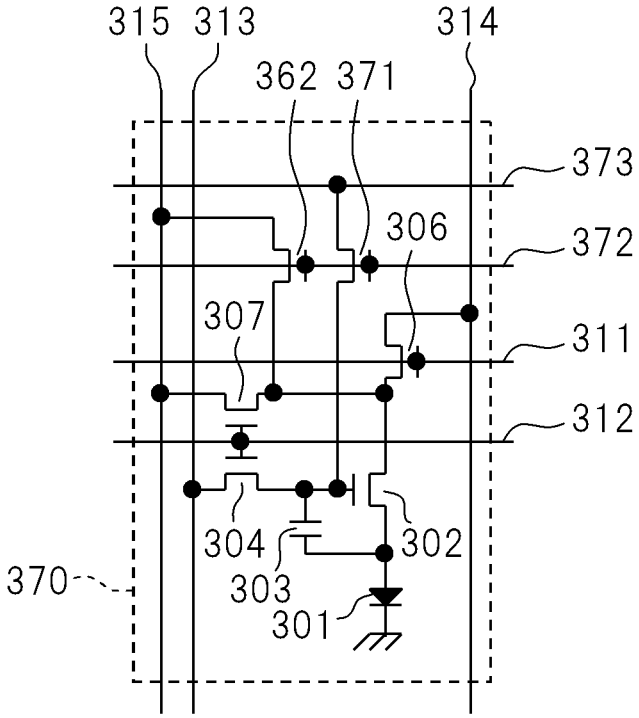
FIG. 16 is a diagram that schematically shows each pixel of the display device in a fifth embodiment of the present invention.

FIG. 16 is a diagram that schematically shows each pixel of a display device in a fifth embodiment. As shown in FIG. 16, each pixel 370 has an organic EL element 301. One end of the organic EL element 301 is grounded to a common cathode electrode, and the other end thereof is connected to the power source line 314 via the driving TFT 302 and the light emitting control switch 306.

The storage capacitor 303 is provided between the gate and the source of the driving TFT 302. The gate of the driving TFT 302 is connected to the signal line 313 via the gate switch 304, and the drain of the driving TFT 302 is connected to the low voltage line 315 via the channel switch 307. Furthermore, the gate of the driving TFT 302 is connected to a voltage control 373 via the gate voltage switch 71, and the drain of the driving TFT 302 is connected to the low voltage line 315 via the second channel switch 362.

The gate of the light emitting control switch 306 is connected to the light emitting control line 311, and the gates of the gate switch 304 and the channel switch 307 are connected to the gate scanning line 312. Furthermore, the gates of a gate voltage switch 371 and the second channel switch 362 are connected to a third gate scanning line 372.

In addition, each switch and the driving TFT 302 may be constituted by the amorphous Si-TFT of n channel having the same basic structure other than the size. Furthermore, for example, each pixel may be provided on the glass substrate. Furthermore, since the basic operation of each pixel 370 shown in FIG. 16 is similar to the first embodiment, the description thereof will be omitted.

Figure 17:
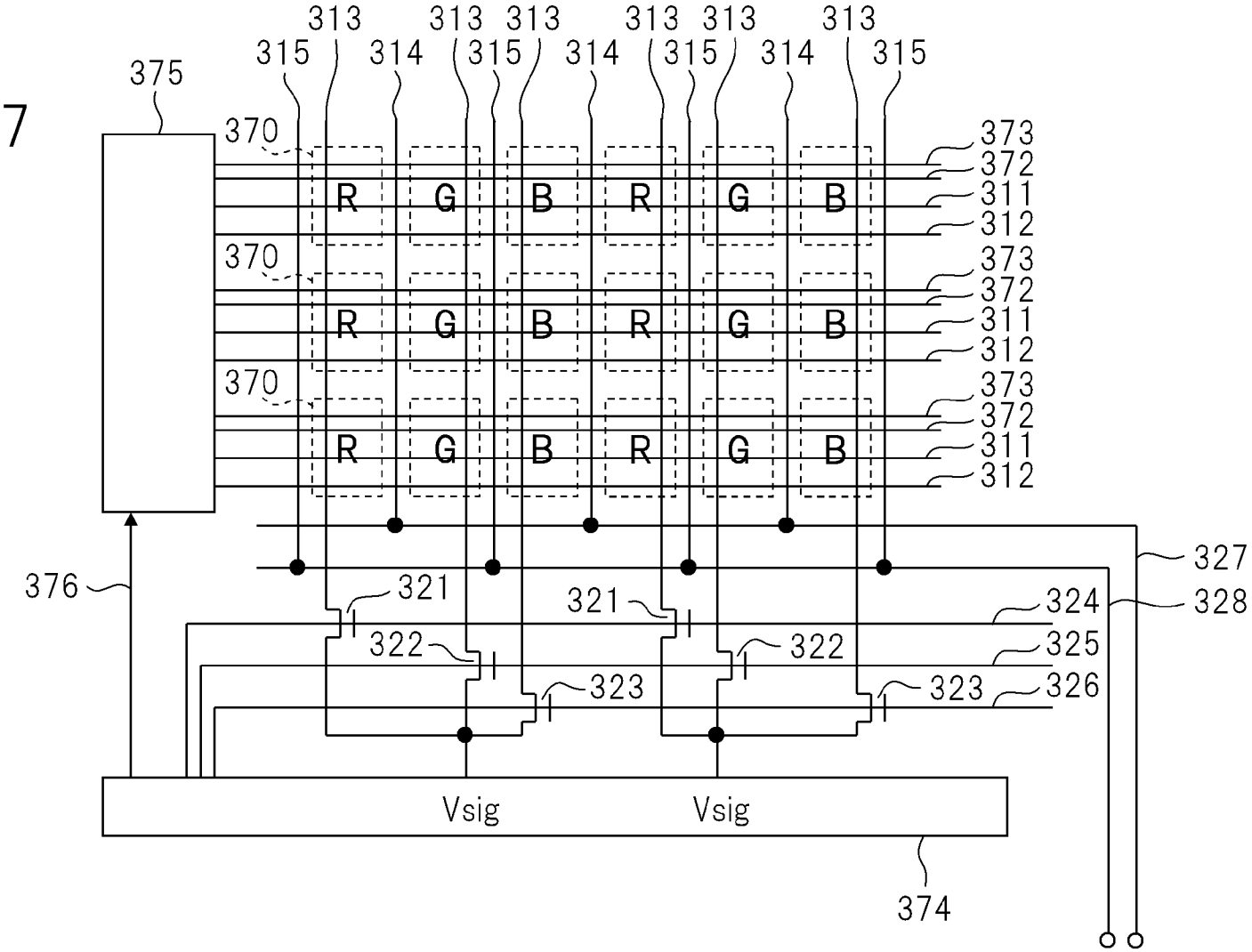
FIG. 17 is a diagram that shows an outline of the driving circuit in the fifth embodiment of the present invention.

FIG. 17 is a diagram that shows an outline of the driving circuit in the fifth embodiment. FIG. 17 shows the pixel 370 of 6×3 dots for the simplification of the description, but it is needless to say that other numbers of pixels may be used as necessary. Furthermore, organic EL elements 301 of three colors of red (R), green (G), and blue (B) may be provided in the pixels 370 of 3 dots in the horizontal direction, which are one display unit, respectively.

As shown in FIG. 17, each pixel 370 is connected to the light emitting control line 311, the gate scanning line 312, the third gate scanning line 372, and the voltage control 372 in the horizontal direction. Furthermore, one ends of the light emitting control line 311, the gate scanning line 312, the third gate scanning line 372, and the voltage control 373 are connected to a vertical scanning circuit 375.

The power source line 314 and the low voltage line 315 are connected to the power source input line 327 and the low voltage line input line 328 at one ends thereof, respectively, and, for example, 10 V and 0 V are input from the outside, respectively. The signal line 313 is connected to a driver IC 374 via switch-over switches 321, 322, and 323 by the corresponding emission colors of RGB.

The gate scanning lines 324, 325, and 326 to be connected to the gates of the switch-over switches 321, 322, and 323 and the control line group 376 of the vertical scanning circuit 375 are connected to the driver IC 374. The driver IC 374 outputs the signal voltage VSig. In addition, for example, the signal voltage VSig has a value of 0 to 5 V.

The vertical scanning circuit 375 selectively outputs the high voltage VH, and the low voltage VL to the voltage control 373. In addition, for example, the high voltage VH has a voltage value of 7 V, and the low voltage VL has a voltage value of 0 V.

In addition, each switch-over switch 321 or the like and the vertical scanning circuit 375 may be constituted by the amorphous Si-TFT of n channel having the same basic structure other than the size, and may be provided on the same glass substrate as the pixel 370. Furthermore, the driver IC 374 may be formed as a Si semiconductor chip, and may be installed on the glass substrate in a COG (Chip-on Glass) manner.

Figure 18:
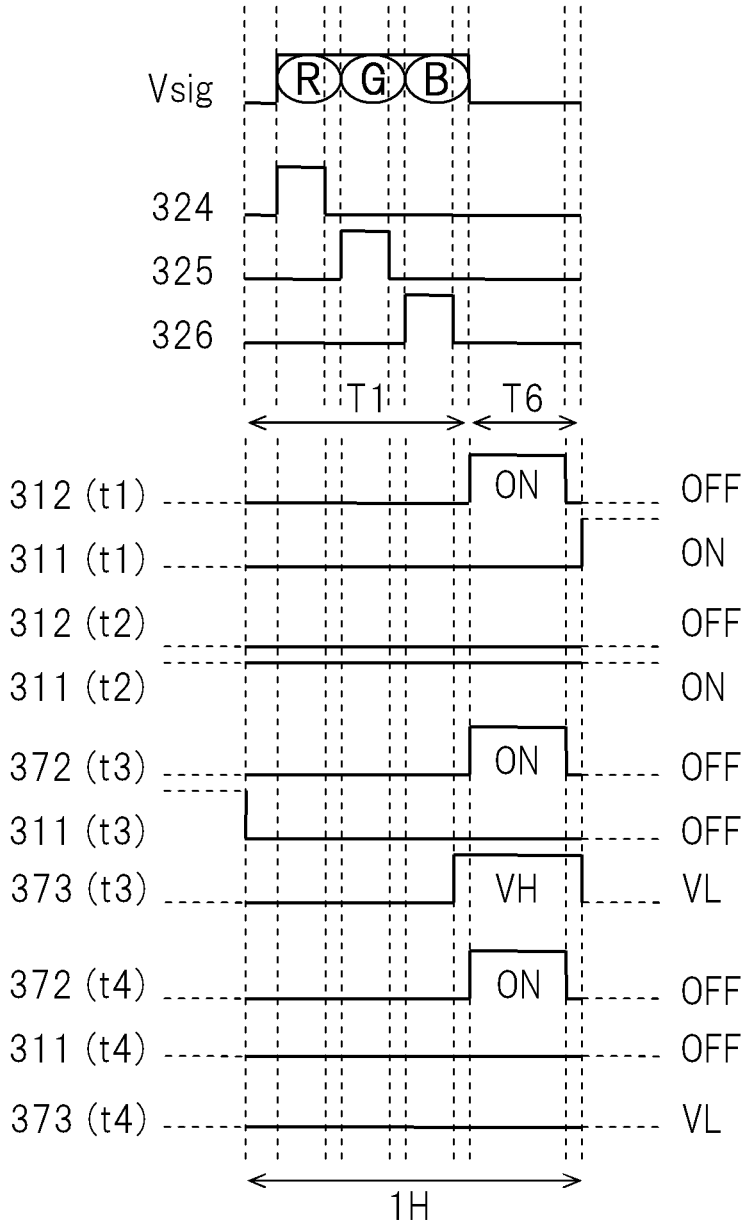
FIG. 18 is an operation timing diagram of the driving circuit in the fifth embodiment of the present invention.

FIG. 18 is an operation timing diagram of the driving circuit in the fifth embodiment. A horizontal direction indicates a time axis and indicates 1 Horizontal scanning period (1H). Vsig corresponds to the output voltage of the signal line 313 in the driver IC 374. 324, 325, and 326 correspond to the gate scanning lines 324, 325, and 326. The upside indicates on and the downside indicates off, respectively. In addition, Vsig, 324, 325, and 326 are signals that are repeated for each 1H.

A timing diagram of a lower half part shows the scanning timings of the light emitting control line 311, the gate scanning lines 312, the third gate scanning line 372, and the voltage control 373 relating to the timings t1, t2, t3, and t4, respectively. Herein, the timings t1, t2, t3, and t4 are the same as t1, t2, t3, and t4 shown in FIG. 4 and correspond to the operation of the first pixel at the times t1, t2, t3, and t4, respectively.

Next, 1H period is divided into periods of T1 and T6, and the operation will be sequentially described.

At the period T1, the output voltage of the signal line 313 is output from the driver IC 374 in the order of RGB and is output to the signal line 313 by the switch-over switches 321, 322, and 323 that are scanned by the gate scanning lines 324, 325, and 326. All of the light emitting control line 311, the gate scanning line 312, and the third gate scanning line 372 are turned off at the timings t1, t3, and t4. Furthermore, VL (0V) is input to the voltage control 373.

At the period T6, the gate scanning line 312 is turned on in the pixel 370 corresponding to the timing t1 so that the gate switch 304 and the channel switch 307 of the pixel are turned on.

Herein, when the output voltage of the signal line 313 has a certain degree of light emitting signal, the driving TFT 302 is turned on, and 0 V, which is the voltage of low voltage line 315, is written on the anode of the organic EL element 301 via the channel switch 307 and the driving TFT 302. Thus, at both ends of the storage capacitor 303, the output voltage of the signal line 313 as the display voltage is written as it is.

Meanwhile, when the output voltage of the signal line 313 nearly does not have the light emitting signal, the driving TFT 302 is not turned on, and thus, the output voltage of the signal line 313 is written at both ends of the storage capacitor 303 by a capacitor division with an inter-terminal capacitor of the organic EL element 301. However, as mentioned below, because the initial value of the anode voltage of the organic EL element 301 is 0 V and because the inter-terminal capacitor of the organic EL element 301 is sufficiently large, the display voltage to be written becomes a value of about 90% of the output voltage of the signal line 313.

Further, at the same period of T6, in the pixel corresponding to the timing t3, the third gate scanning line 372 is turned on so that the gate voltage switch 371 and the second channel switch 362 of the pixel 360 are turned on. Herein, simultaneously, VH (7 V) is applied to the voltage control 373, and VH (7 V) is written on the gate of the driving TFT 302 from the voltage control 373 via the gate voltage switch 371. Thus, the driving TFT 302 is turned on, and 0 V, which is the voltage of low voltage line 315, is written on the anode of the organic EL element 301 via the second channel switch 362 and the driving TFT 302. Thus, at both ends of the storage capacitor 303, instead of the display voltage, VH (7 V) is written as it is.

Furthermore, at the same period of T6, in the pixel corresponding to the timing t4, the third gate scanning line 372 is turned on so that the gate voltage switch 371 and the second channel switch 362 of the pixel are turned on. Herein, simultaneously, VL (0 V) is applied to the voltage control 373, and VL (0 V) is written on the gate of the driving TFT 302 from the voltage control 373 via the gate voltage switch 371. Thus, the driving TFT 302 is turned off, and at both ends of the storage capacitor 303, VL (0 V) is written by the capacitor division with the inter-terminal capacitor of the organic EL element 301.

At this time, because 0 V is written on the anode of the organic EL element 301 in advance at the timing t3 and because the inter-terminal capacitor of the organic EL element 301 is sufficiently great, VL (0 V) is written at both ends of the storage capacitor 303 nearly as it is. In addition, as mentioned above, it may be considered that the anode voltage of the organic EL element 301 maintains almost 0 V as it is until reaching the timing t1.

Next, from the viewpoint of the 1 frame period, a specific operation of the driving circuit will be described. During the period A (the light emitting period of the organic EL element 301) represented by the timing t2, the light emitting control line 311 is turned on so that the light emitting control switch 306 is fixed in the on-state. Since the display voltage is written at both ends of the storage capacitor 303 in advance at the timing t1 and the display voltage is applied between the gate and the source of the driving TFT 302, the driving TFT 302 drives the organic EL element 301 and causes the same to emit light by the current corresponding to the display voltage. In addition, the period A is, for example, about half of 1 frame.

Next, the light emitting control line 311 is turned off so that the light emitting control switch 306 is turned off. Then, the stress voltage VH (7 V) is written on the storage capacitor 303 provided between the gate and the source of the driving TFT 302 at the timing t3 and is held during period B.

Next, the relief voltage VL (0 V) is written on the storage capacitor 303 provided between the gate and the source of the driving TFT 302 at the timing t4, and is held during period C. After that, returning to the initial timing t1, a new display voltage is written. The operation as above is repeated for 1 frame period.

According to the present embodiment, as shown in FIG. 18, it is possible to simplify the driving order of the scanning line during 1H period. Thus, according to the present embodiment, it is possible to easily realize a highly precision display device of which 1H period is short and a display device which is difficult to perform the complex scanning due to the large-scale and the high driving capacitor of the scanning line or the like.

Furthermore, like the fourth embodiment, the driver IC 374 does not need to output the stress voltage VH (7 V) to the signal line 313. Thus, the high voltage output terminal can be limited to the driving terminals of the gate scanning lines 324, 325, and 326 of the switch-over switches 321, 322, and 323, which are the TFT circuits, and the control line group 366 of the vertical scanning circuit 365. Thus, most of the driver IC 374 can be constituted by the low voltage-resistant circuit so that the size and the cost of the driver IC 374 can be reduced. Moreover, for example, the existing liquid crystal display driver IC can be used in the driver IC 374 so that the cost can be reduced.

Further, like the first embodiment, according to the present embodiment, it is possible to solve the burning due to the characteristic change of the driving TFT 302 by applying the stress voltage. Furthermore, by providing the application period of the relief voltage, it is possible to restore the excessive characteristic change of the driving TFT 302 due to the stress voltage. Consequentially, it is possible to display an image display at the stable luminance over a long period. In other words, it is possible to uniformly restore the characteristic change with respect to the larger characteristic change of the driving TFT 302 due to the stress voltage application so that it is possible to realize a display device which does not generate the burning or decline in luminance due to the driving circuit.

Sixth Embodiment

Figure 19:
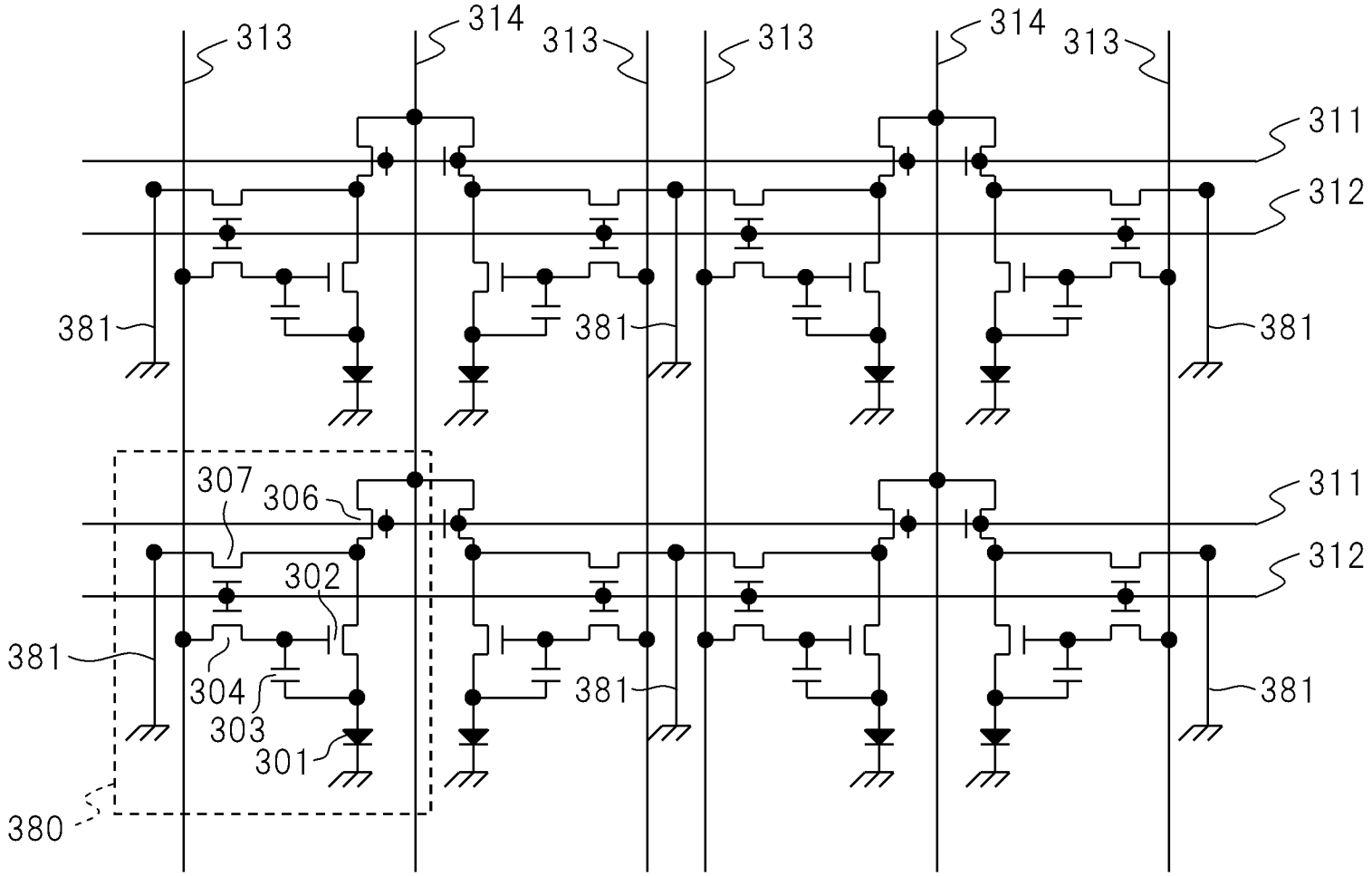
FIG. 19 is a diagram that schematically shows arrangements of each pixel of the display device in a sixth embodiment of the present invention.

FIG. 19 is a diagram that schematically shows an arrangement of each pixel of a display device in a sixth embodiment.

The sixth embodiment is different from the first embodiment in the configuration of the low voltage line. Other points are similar to those of the first embodiment, and the descriptions of the similar points will be omitted. Furthermore, FIG. 19 shows only total eight pixels 380 of length of 4 dots and width of 2 dots for the simplification of description, but it is needless to say that other numbers of dots may be used as necessary.

As shown in FIG. 19, each pixel 380 shares the power supply line 314 and the low voltage line 381 between the left and right pixels 380 for the simplification of the layout aimed at improving the yield. Specifically, the low voltage line 381 is connected between the adjacent pixels 380 and is connected to the common cathode ground electrode of the organic EL element 301.

Herein, in a display device such as a TV exceeding 40 inches, when the common cathode ground electrode of the organic EL element 301 is formed of a transparent electrode, the resistance becomes too large. Thus, in the present embodiment, the common cathode ground electrode of the organic EL element 301 is formed of, for example, a metal Al thin film having a thickness of 200 nm, and a so-called bottom emission structure is used. As a result, the resistance of the common cathode electrode ground electrode can be sufficiently suppressed to have low value. As a result, a contact hole is formed in the pixel portion, and the low voltage line 381 can be connected to the common cathode ground electrode.

Thus, in the present embodiment, it is not necessary to extend the low voltage line 381 into the pixel matrix. Therefore, the layout of the pixel 380 can be simplified. Further, since it is not necessary to provide the low voltage line input line 328 that requires a thick wiring so as to avoid the voltage drop, the frame region can be reduced.

Furthermore, according to the present embodiment, like the first embodiment, it is possible to solve the burning due to the characteristic change of the driving TFT 302 by applying the stress voltage. Moreover, by providing the application period of the relief voltage, it is possible to restore the excessive characteristic change of the driving TFT 302 due to the stress voltage. Consequentially, it is possible to display an image at the stable luminance is possible over a long period. In other words, it is possible to uniformly restore the characteristic change with respect to the larger characteristic change of the driving TFT 302 due to the stress voltage application, and it is possible to realize a display device which does not generate the burning or decline in luminance due to the driving circuit.

In addition, in the present embodiment, as mentioned above, although a method of connecting the low voltage line 381 to the common cathode ground electrode is combined with the bottom emission structure, it is needless to say that the method may be combined with a top emission structure as needed.

Seventh Embodiment

Figure 20:
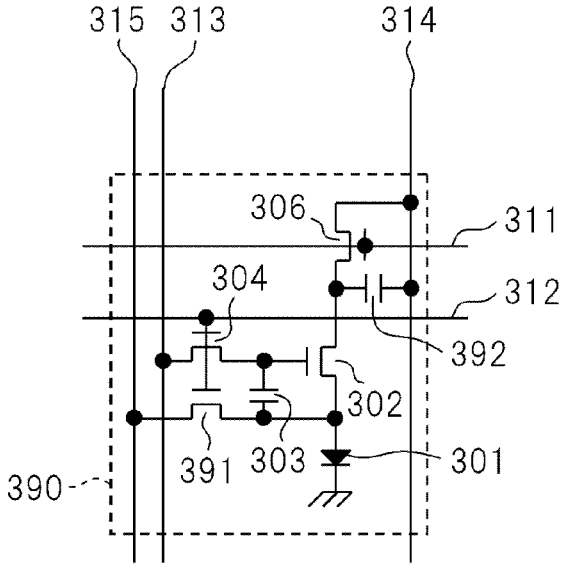
FIG. 20 is a diagram that schematically shows arrangements of each pixel of the display device in a seventh embodiment of the present invention.

FIG. 20 is a diagram that schematically shows arrangements of each pixel of a display device in a seventh embodiment of the present invention. In the seventh embodiment, a part of the configuration of the pixel is different from the first embodiment. Other points are similar to those of the first embodiment, and the descriptions thereof will be omitted.

As shown in FIG. 20, each pixel 390 has an organic EL element 301. One end of the organic EL element 301 is grounded to a common cathode electrode, and the other end thereof is connected to the power source line 314 via the driving TFT 302 and the light emitting control switch 306.

The storage capacitor 303 is provided between the gate and the source of the driving TFT 302. The gate of the driving TFT 302 is connected to the signal line 313 via the gate switch 304. The source of the driving TFT 302 is connected to the low voltage line 315 via the source switch 391. The gate of the light emitting control switch 306 is connected to the light emitting control line 311, and the gates of the gate switch 304 and the source switch 391 are connected to the gate scanning line 312. A stabilizing capacitor 392 is provided between the drain of the driving TFT 302 and the power source line 314.

In addition, each switch 391 or the like and the driving TFT 302 may be constituted by the amorphous Si-TFT of n channel having the same basic structure other than the size, and each pixel may be provided on the glass substrate.

In the present embodiment, since the source switch 391 is provided instead of the channel switch 307, the anode voltage of the organic EL element 301 can be directly controlled from the source switch 391. This point is different from the first embodiment in which the anode voltage of the organic EL element 301 is controlled from the channel switch 307 via the driving TFT 302. Thus, according to the present embodiment, regardless of the gate voltage of the driving TFT 302, the anode voltage of the organic EL element 301 can be directly controlled. Thus, the control of the storage capacitor 303 can be further stabilized.

In the case of the first embodiment, since the relatively large capacitor of the organic EL element 301 is connected to the source terminal of the driving TFT 302, even when the driving TFT 302 is turned off, the voltage of the source terminal of the driving TFT 302 is stabilized. However, upon controlling the voltage of the drain terminal of the driving TFT 302 via the driving TFT 302, when the gate voltage of the driving TFT 302 is low, in some cases, the controllability is degraded. That is, upon turning the driving TFT 302 off when the light emitting control switch 306 is turned off, the voltage of the drain terminal of the driving TFT 302 is hard to be stabilized.

Thus, in the present embodiment, a new stabilizing capacitor 392 is provided in the source terminal of the driving TFT 302. Thus, the drain terminal voltage of the driving TFT 302 can be stabilized. Specifically, the drain terminal voltage of the driving TFT 302 can be stabilized by the ratio of the inter-drain gate stabilizing capacitor and the stabilizing capacitor 392, with respect to the displacement of the gate voltage of the driving TFT 302.

Furthermore, according to the present embodiment, like the first embodiment, it is possible to solve the burning due to the characteristic change of the driving TFT 302 by applying the stress voltage. Furthermore, by providing the application period of the relief voltage, it is possible to restore the excessive characteristic change of the driving TFT 302 due to the stress voltage. Consequentially, it is possible to display an image display at the stable luminance over a long period. In other words, it is possible to uniformly restore the characteristic change with respect to the larger characteristic change of the driving TFT 302 due to the stress voltage application, and it is possible to realize a display device which does not generate the burning or decline in luminance due to the driving circuit.

Eighth Embodiment

Figure 21:
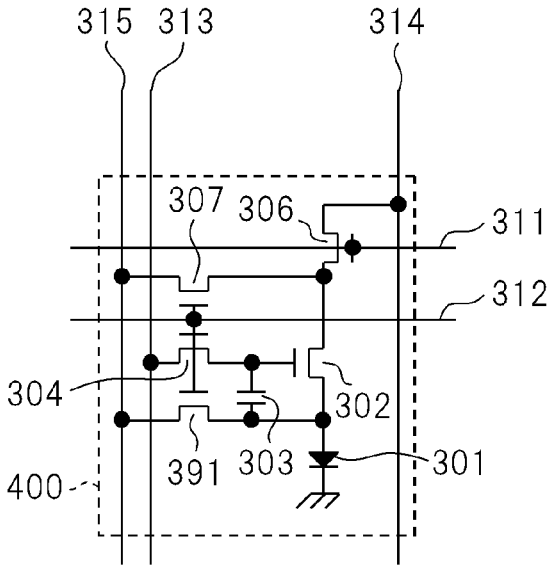
FIG. 21 is a diagram that schematically shows each pixel of the display device in an eighth embodiment of the present invention.

FIG. 21 is a diagram that schematically shows each pixel of a display device in an eighth embodiment of the present invention. In the eighth embodiment, a part of the configuration of the pixel is different from the first embodiment. Other points are similar to those of the first embodiment, and the descriptions thereof will be omitted.

As shown in FIG. 21, each pixel 400 has an organic EL element 301. One end of the organic EL element 301 is grounded to a common cathode electrode, and the other end thereof is connected to the power source line 314 via the driving TFT 302 and the light emitting control switch 306.

The storage capacitor 303 is provided between the gate and the source of the driving TFT 302. The gate of the driving TFT 302 is connected to the signal line 313 via the gate switch 304, and the drain of the driving TFT 302 is connected to the low voltage line 315 via the source switch 307. Furthermore, the source of the driving TFT 302 is connected to the low voltage line 315 via the source switch 391.

The gate of the light emitting control switch 306 is connected to the gate switch 304 and the channel switch 307 by the light emitting control line 311. The gate of the source switch 391 is connected to the gate scanning line 312. In addition, each switch and the driving TFT 302 may be constituted by the amorphous Si-TFT of n channel having the same basic structure other than the size, and each pixel 400 may be provided on the glass substrate.

Furthermore, in the present embodiment, since the source switch 391 is further provided, a function of controlling the drain voltage of the driving TFT 302 from the channel switch 307 similar to the first embodiment, and a function of directly controlling the anode voltage of the organic EL element 301 from the source switch 391 are included. Thus, according to the present embodiment, although the number of the switch is increased, it is possible to stabilize the control of the storage capacitor 303 and the control of the drain terminal of the driving TFT 302. Thus, the operation margin can be remarkably improved so as to provide a manageable display device.

Furthermore, according to the present embodiment, like the first embodiment, it is possible to solve the burning due to the characteristic change of the driving TFT 302 by applying the stress voltage. Furthermore, by providing the application period of the relief voltage, it is possible to restore the excessive characteristic change of the driving TFT 302 due to the stress voltage. Consequentially, it is possible to display an image display at the stable luminance over a long period. In other words, it is possible to uniformly restore the characteristic change with respect to the greater characteristic change of the driving TFT 302 due to the stress voltage application, and it is possible to realize a display device which does not generate the burning or decline in luminance due to the driving circuit.

Ninth Embodiment

Figure 22:
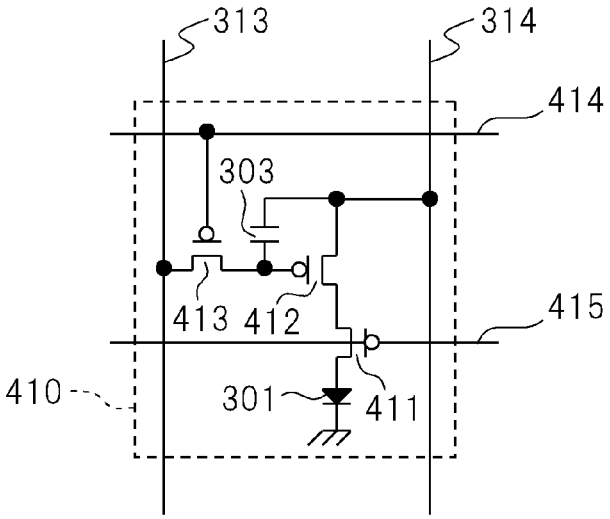
FIG. 22 is a diagram that schematically shows each pixel of the display device in a ninth embodiment of the present invention.

FIG. 22 is a diagram that schematically shows each pixel of a display device in a ninth embodiment of the present invention. As shown in FIG. 22, each pixel 410 has an organic EL element 301. One end of the organic EL element 301 is grounded to a common cathode electrode, and the other end thereof is connected to the power source line 314 via a light emitting control switch 411 and a driving TFT 412.

The storage capacitor 303 is provided between the gate and the source of the driving TFT 412. The gate of the driving TFT 412 is connected to the signal line 313 via a gate switch 413, and the gate of the light emitting control switch 411 is connected to the light emitting control line 311. The gate of the gate switch 413 is connected to a gate scanning line 414.

In addition, each switch and the driving TFT 412 may be constituted by the microcrystal Si-TFT of p channel having the same basic structure other than the size, and each pixel 410 may be provided on the glass substrate. Furthermore, the operation of the ninth embodiment is basically the same as that of the first embodiment, but, in the ninth embodiment, as mentioned below, since the driving TFT 412 is a pMOS, it is needless to say that the stress voltage and the relief voltage to be applied to the gate are opposite to those of the first embodiment.

Figure 23:
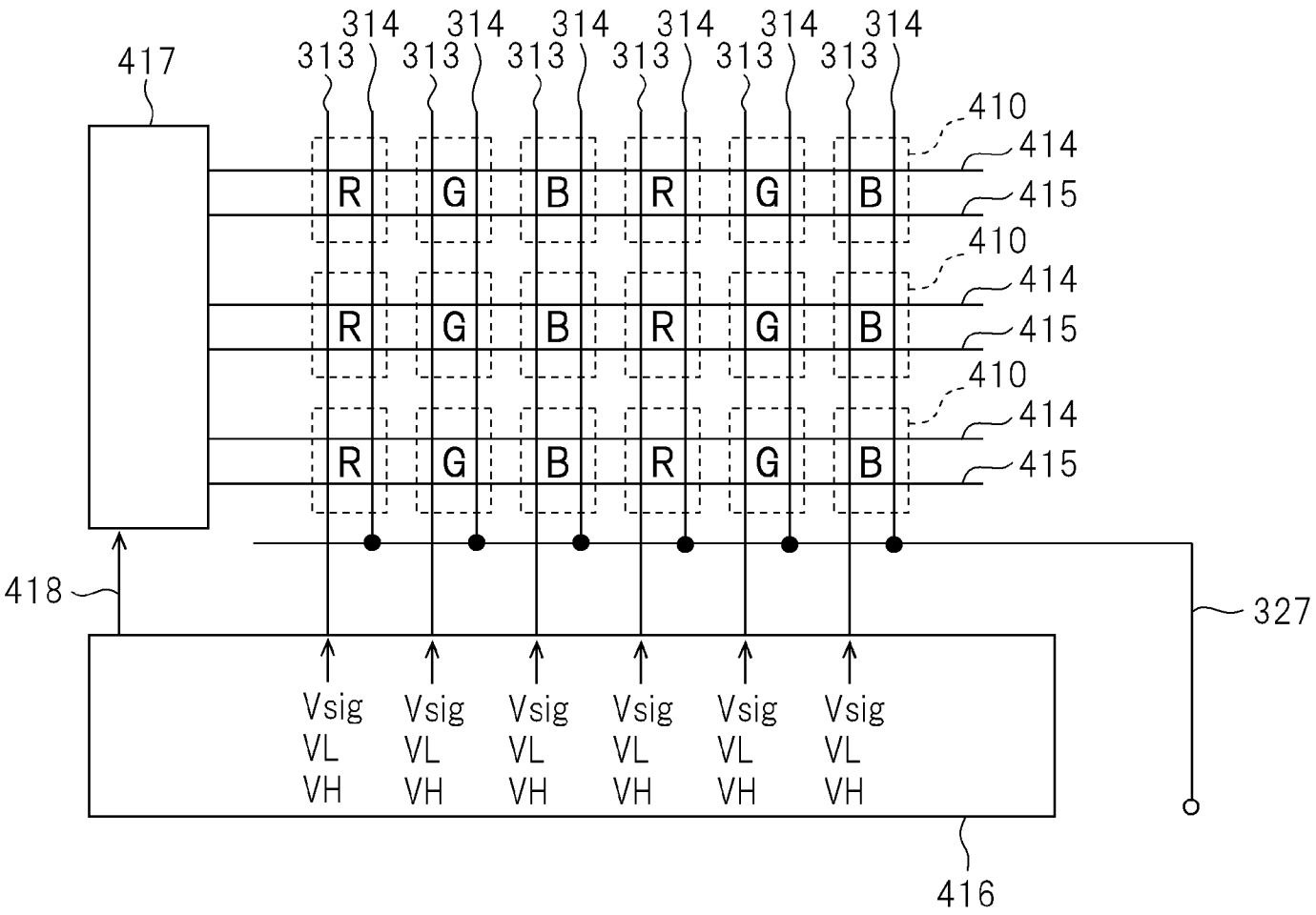
FIG. 23 is a diagram that shows an outline of the driving circuit in the ninth embodiment of the present invention.

FIG. 23 is a diagram that shows an outline of the driving circuit in the ninth embodiment. FIG. 23 shows only the pixel 410 of 6×3 dots for the simplification of the drawings, but it is needless to say that other numbers of pixels may be used as necessary. Furthermore, organic EL elements 301 of three colors of red (R), green (G), and blue (B) may be provided, in the pixels 410 of 3 dots in the horizontal direction, which are one display unit, respectively. In addition, the pixel 410 does not adopt a line symmetry layout unlike the first embodiment.

As shown in FIG. 23, the light emitting control line 415 and the gate scanning line 414 are connected to each pixel 410 in the horizontal direction. Further, one ends thereof are connected to a vertical scanning IC 417. One end of the power source line 314 is connected to the power source input line 327, and, for example, 10 V is input from the outside. The signal line 313 is directly connected to a driver IC 416. Furthermore, a control line group 418 of the vertical scanning IC 417 is also connected to the driver IC 416.

The driver IC 416 selectively outputs the signal voltage Vsig, the low voltage VL, and the high voltage VH to each signal output terminal. In addition, for example, the signal voltage Vsig is 5 to 10 V, the low voltage VL is 0 V, and the high voltage VH is 10 V. Furthermore, the vertical scanning IC 417 and the driver IC 416 may be formed as a Si semiconductor chip, and may be installed on the glass substrate in a COG (Chip-on Glass) manner.

Figure 24:
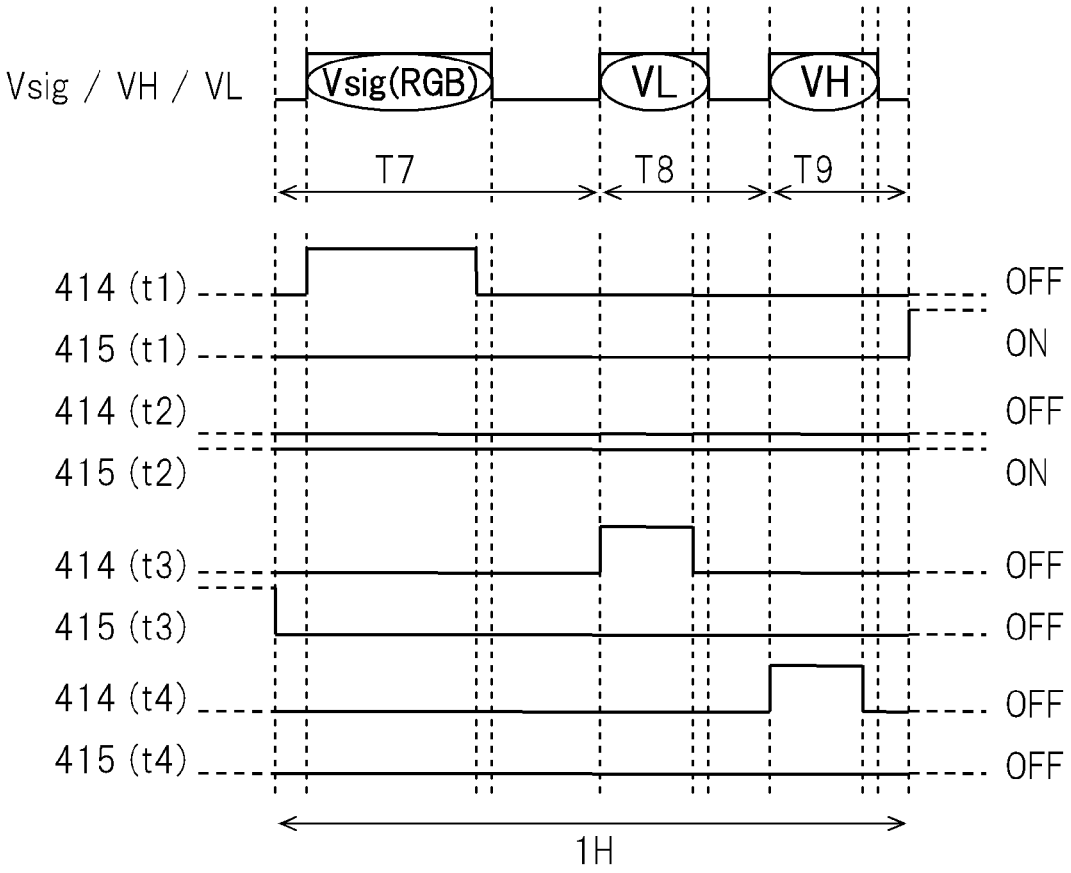
FIG. 24 is an operation timing diagram of the driving circuit in the ninth embodiment of the present invention.

FIG. 24 is an operation timing diagram of the driving circuit in the ninth embodiment. A horizontal direction indicates a time axis and indicates 1 Horizontal scanning period (1H). Vsig (three kinds of signals exist by RGB) corresponds to the output voltage of the signal line 313 in the driver IC 416, VH corresponds to the high voltage output in the driver IC 416, VL corresponds to the low voltage output in the driver IC 416, and the upside indicates on and the downside indicates off, respectively. In addition, Vsig, VH, and VL are signals that are repeated for each 1H.

A timing diagram of a lower half part shows the scanning timings of the gate scanning line 414 and the light emitting control line 415 relating to the timings t1, t2, t3, and t4. Herein, the timings t1, t2, t3, and t4 are the same as t1, t2, t3, and t4 shown in FIG. 4 and correspond to the operation of the first pixel at the times t1, t2, t3, and t4, respectively.

Next, 1H period is divided into periods of T7, T8, and T9 and the operation will be sequentially described.

At the period T7, the output voltage of the signal line 313 is output from the driver IC 416 to the signal line 313. The gate scanning line 414 is turned on at the timing t1 so that the gate switch 413 of the pixel is turned on. At this time, the output voltage of the signal line 313 is written on one end of the storage capacitor 303 as it is. After that, the gate scanning line 414 is turned off so that the output voltage of the signal line 313 is output to the storage capacitor 303. In addition, at the timings t3 and t4, the gate scanning line 414 and the light emitting control line 415 are turned off.

At the period T8, the voltage VL (0 V) is output from the driver IC 416, and the voltage VL is output to the signal line 313. Herein, the gate scanning line 414 is turned on at the timing t3 so that the gate switch 413 of the pixel is turned on. At this time, the voltage VL (0 V) is written on one end of the storage capacitor 303 as it is. After that, the gate scanning line 414 is turned off so that the output VL (0 V) is output to the storage capacitor 303. In addition, at the timings t1 and t4, the gate scanning line 414 and the light emitting control line 415 are turned off.

At the period T9, the voltage VH (10 V) is output from the driver IC 416, and the voltage VH is output to the signal line 313. Herein, the gate scanning line 414 is turned on at the timing t4 so that the gate switch 413 of the pixel is turned on. At this time, the voltage VH (10 V) is written on one end of the storage capacitor 303 as it is. After that, the gate scanning line 414 is turned off so that the output VH (10 V) is output to the storage capacitor 303. In addition, at the timings t1 and t3, the gate scanning line 414 and the light emitting control line 415 are turned off.

Next, from the viewpoint of the 1 frame period, a specific operation of the driving circuit will be described. During the period A (the light emitting period of the organic EL element 301) represented by the timing t2, the light emitting control line 415 is turned on so that the light emitting control switch 411 fixed in the on-state. Because the display voltage is written at both ends of the storage capacitor 303 in advance at the timing t1 and because the display voltage is applied between the gate and the source of the driving TFT 412, the driving TFT 412 drives the organic EL element 301 to emit light by the current corresponding to the display voltage. In addition, the period A is, for example, about half of 1 frame.

Next, the light emitting control line 415 is turned off so that the light emitting control switch 411 is turned off. Then, the stress voltage VL (0 V) is written on the storage capacitor 303 provided between the gate and the source of the driving TFT 412 at the timing t3 and is held during period B. Next, the relief voltage VH (10 V) is written on the storage capacitor 303 provided between the gate and the source of the driving TFT 412 at the timing t4, and is held during period C. After that, returning to the initial timing t1, a new display voltage is written. The operation as described above is repeated for 1 frame period.

According to the present embodiment, since the pixel circuit can be simplified by using the pMOS transistor as TFT, it is advantageous to realize the high precision and the high yield. Further, by using the vertical scanning IC 417 and the driver IC 416, it is not necessary to provide the TFT circuit around the pixel 410. Thus, the high yield can be realized. Furthermore, by using the pMOS-TFT, it is also possible to cope with the TFT process that is hard to produce an nMOS-TFT of high performance like the organic transistor.

Moreover, according to the present embodiment, like the first embodiment, it is possible to solve the burning due to the characteristic change of the driving TFT 302 by applying the stress voltage. Furthermore, by providing the application period of the relief voltage, it is possible to restore the excessive characteristic change of the driving TFT 412 due to the stress voltage. Consequentially, it is possible to display an image at the stable luminance over a long period. In other words, it is possible to uniformly restore the characteristic change with respect to the larger characteristic change of the driving TFT 412 due to the stress voltage application, and it is possible to realize a display which does not generate the burning or decline in luminance due to the driving circuit.

Tenth Embodiment

Figure 25:
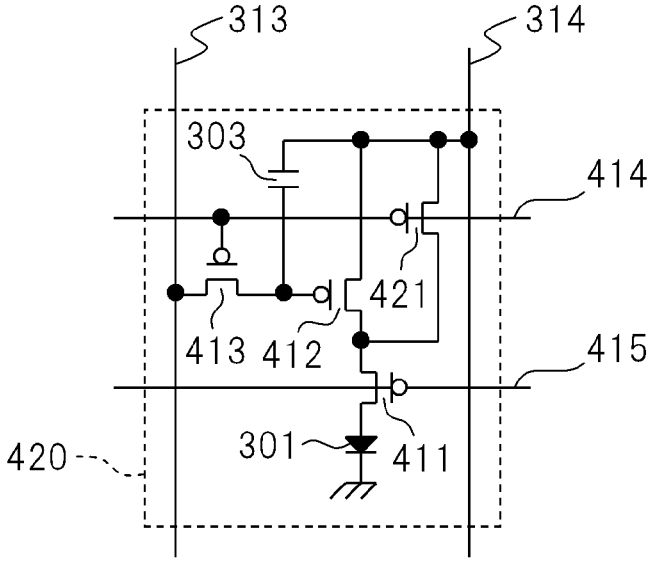
FIG. 25 is a diagram that schematically shows each pixel of the display device in a tenth embodiment of the present invention.

FIG. 25 is a diagram that schematically shows each pixel of a display device in a tenth embodiment of the present invention. In the tenth embodiment, a part of the configuration of the pixel is different from the ninth embodiment. Other points are similar to those of the ninth embodiment, and the descriptions of the similar points will be omitted.

As shown in FIG. 25, each pixel 420 has an organic EL element 301. One end of the organic EL element 301 is grounded to a common cathode electrode, and the other end thereof is connected to the power source line 314 via the light emitting control switch 411 and the driving TFT 412.

The storage capacitor 303 is provided between the gate and the source of the driving TFT 412. The gate of the driving TFT 412 is connected to the signal line 313 via the gate switch 413. The gate of the light emitting control switch 411 is connected to the light emitting control line 415. The gate of the gate switch 413 is connected to the gate scanning line 414. The above is the same as the ninth embodiment.

However, in the tenth embodiment, a channel switch 421 to be controlled by the gate scanning line 414 is provided between the drain of the driving TFT 412 and the power source line 314. In addition, each switch 421 or the like and the driving TFT 412 may be constituted by the microcrystal Si-TFT of p channel having the same basic structure other than the size, and each pixel 420 may be formed on the glass substrate.

In the present embodiment, when the gate scanning line 414 is turned on, the channel switch 421 is simultaneously turned on. Thus, since the relief voltage applied to the driving TFT 412 is also steadily applied between the gate and the train, the operation can be further stabilized. Furthermore, even when the output voltage of the signal line 313 is written on the storage capacitor 303, it is possible to steadily and uniformly maintain the voltage between the gate and the drain as well as between the gate and the source, and thus, it is possible to prevent the distortion of the luminance gradation generated by the parasitic capacitance between the gate and the drain.

Further, according to the present embodiment, like the first embodiment, it is possible to solve the burning due to the characteristic change of the driving TFT 302 by applying the stress voltage. Furthermore, by providing the application period of the relief voltage, it is possible to restore the excessive characteristic change of the driving TFT 412 due to the stress voltage. Consequentially, it is possible to display an image at the stable luminance over a long period. In other words, it is possible to uniformly restore the characteristic change with respect to the greater characteristic change of the driving TFT 412 due to the stress voltage application, and it is possible to realize a display which does not generate the burning or decline in luminance due to the driving circuit.

In addition, in the first to tenth embodiments described above, it is assumed that the organic EL element 301 has the common cathode electrode, and the nMOS-TFT circuit and the pMOS-TFT circuit are described. However, when it is assumed that the organic EL element 301 has the common anode electrode, each embodiment using the nMOS-TFT can be applied by replacing the nMOS with the pMOS, and each embodiment using the pMOS-TFT can be applied by replacing the pMOS with the nMOS, respectively.

Eleventh Embodiment

Figure 26:
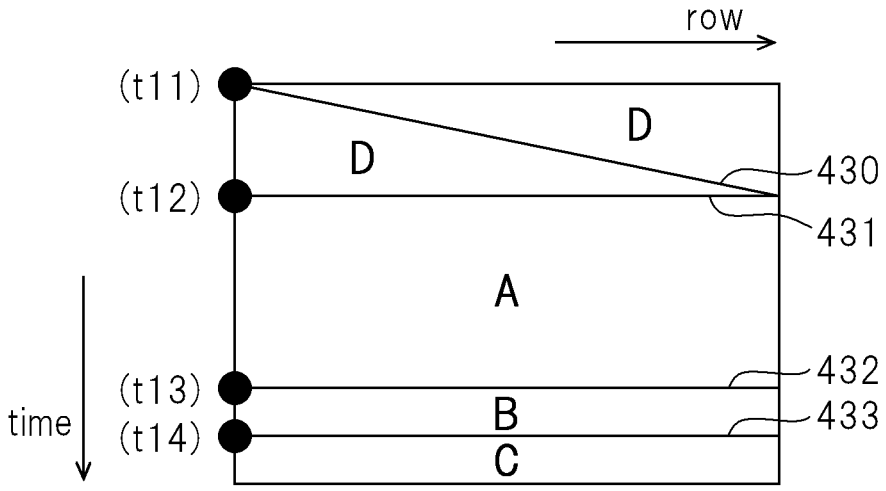
FIG. 26 is a diagram for describing the operation of the pixel in an eleventh embodiment of the present invention.

FIG. 26 is a diagram for describing the operation of the pixel in an eleventh embodiment. In the eleventh embodiment, the operation order of the pixel is different from that of the first embodiment. Other points are similar to those of the first embodiment, and the descriptions of the similar points will be omitted.

A horizontal direction of FIG. 26 indicates an array (row) of a vertical direction of each pixel, and corresponds to the pixels from the first row to the final row in the horizontal direction. The vertical direction indicates a time axis (time) of each pixel, and the vertical length corresponds to 1 frame period (1/60 seconds).

Diagonally described solid lines indicate the scanning timing of each pixel row. Specifically, a solid line 430 indicates the writing of the display voltage to the storage capacitor 303, a solid line 432 indicates the writing of the stress voltage to the storage capacitor 303, and a solid line 433 indicates the writing of the relief voltage to the storage capacitor 303. A solid line 431 indicates the starting of the light emission due to the turn-on of the light emitting control switch 306, and the light emission is finished in the solid line 432.

In the present embodiment, the writing of the display voltage onto the storage capacitor 303 indicated by the solid line 430 is performed by a line-sequential scanning like the first embodiment. However, the writing of the stress voltage onto the storage capacitor 303 indicated by the solid line 432, and the writing of the relief voltage onto the storage capacitor 303 indicated by the solid line 433 are collectively performed in the all pixels.

In addition, like the first embodiment, in FIG. 26, a period A indicates a light emitting period of the organic EL element 301 due to the driving TFT 302, a period B indicates an application period of the stress voltage to the driving TFT 302, and a period C indicates an application period of the relief voltage to the driving TFT 302.

FIGS. 27A to 27D are operation timing diagrams of the driving circuit in the eleventh embodiment. A horizontal direction indicates a time axis and indicates 1 Horizontal scanning period (1H). Vsig corresponds to the output voltage of the signal line 313 in the driver IC 330, VH corresponds to the high voltage output in the driver IC 330, and VL indicates the low voltage output in the driver IC 330. 324, 325, and 326 correspond to the gate scanning lines 324, 325, and 326, and the upside is on and the downside is off, respectively. In addition, Vsig, VH, VL, 324, 325, and 326 are signals that are repeated for each 1H.

Herein, FIGS. 27A to 27D show the scanning timings of 1H period of the light emitting control line 311 and the gate scanning lines 312 at the timings t11, t12, t13, and t14. Herein, the timings t11, t12, t13, and t14 are t11, t12, t13, and t14 shown in FIG. 26 and correspond to the operation of the first pixel 420 at the times t11, t12, t13, and t14, respectively.

Figure 27A:
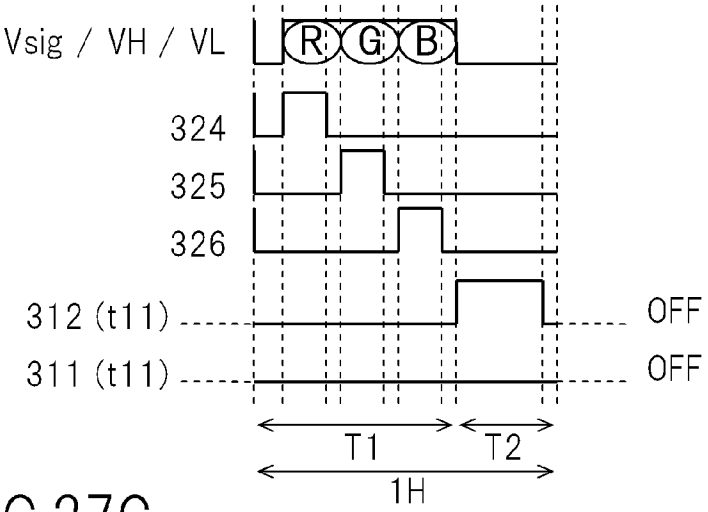
FIG. 27A is a diagram that shows a scanning timing of 1H period at timing t11 shown in FIG. 26.

FIG. 27A shows the scanning timing of 1H period at the period T1. At the period T1, the output voltage of the signal line 313 is output from the driver IC 330 in the order of RGB and is output to the signal line 313 by the switch-over switches 321, 322, and 323 that are scanned by the gate scanning lines 324, 325, and 326. In addition, at this period, all of the light emitting control line 311 and the second gate scanning line 312 are turned off.

At the period T2, the gate scanning line 312 is turned on so that the gate switch 304 and the channel switch 307 of the pixel are turned on. Herein, when the output voltage of the signal line 313 has a certain degree of light emitting signal, the driving TFT 302 is turned on, and 0 V, which is the voltage of low voltage line 315, is written on the anode of the organic EL element 301 via the channel switch 307 and the driving TFT 302. Thus, at both ends of the storage capacitor 303, the output voltage of the signal line 313 as the display voltage is written as it is.

Meanwhile, when the output voltage of the signal line 313 nearly does not have the light emitting signal, the driving TFT 302 is not turned on, and thus, the output voltage of the signal line 313 is written at both ends of the storage capacitor 303 by a capacitor division with an inter-terminal capacitor of the organic EL element 301. However, as mentioned below, because the initial value of the anode voltage of the organic EL element 301 is 0 V and the inter-terminal capacitor of the organic EL element 301 is sufficiently large, the display voltage to be written becomes a value of about 90% of the output voltage of the signal line 313.

Figure 27B:
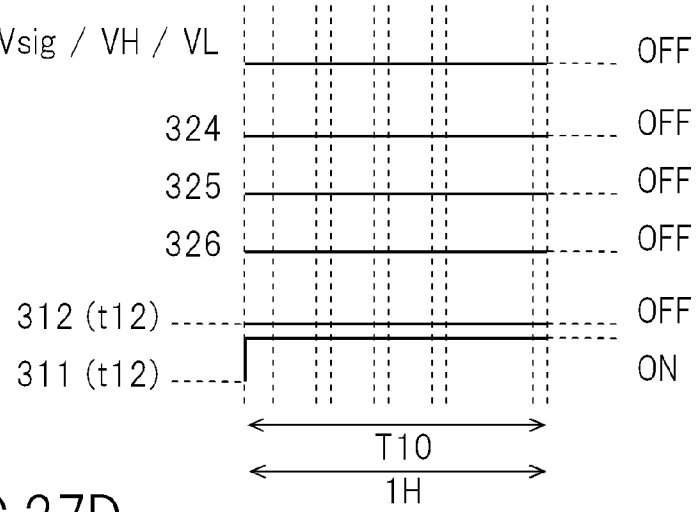
FIG. 27B is a diagram that shows a scanning timing of 1H period at timing t12 shown in FIG. 26.

FIG. 27B shows the scanning timing of 1H period at the timing t12. At the period T10, the light emitting control line 311 is turned on all together at the all pixels 420 so that the light emitting control switch 306 is fixed in on-state. Because the display voltage is written at both ends of the storage capacitor 303 in advance at the timing t11 and the display voltage is applied between the gate and the source of the driving TFT 302, the driving TFT 302 drives the organic EL element 301 to emit light by the current corresponding to the display voltage.

In addition, the light emitting period A starting at the timing t12 is continued, for example, for about half of 1 frame, then, the light emitting control line 311 is turned off in all pixels all together, and the light emitting period A is finished.

Figure 27C:
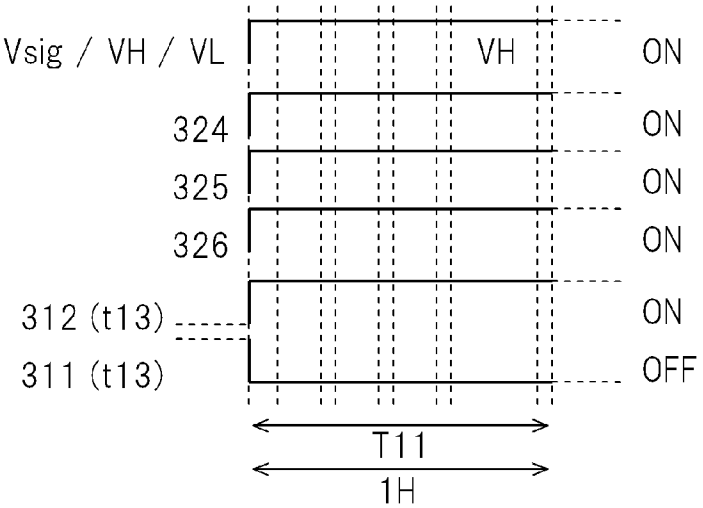
FIG. 27C is a diagram that shows a scanning timing of 1H period at timing t13 shown in FIG. 26.

FIG. 27C shows the scanning timing of 1H period at the timing t13. At the period T11, the voltage VH (7 V) is output from the driver IC 330 and is output to the signal line 313 via the switch-over switches 321, 322, and 323 that are simultaneously turned on by the gate scanning lines 324, 325, and 326.

Herein, the gate scanning lines 312 are turned on all together in all pixels 420 so that the gate switch 304 and the channel switch 307 of each pixel 420 are turned on. Herein, since VH (7 V) is written on the gate of the driving TFT 302 from the gate switch 304 via the signal line 313, the driving TFT 302 is turned on. Thus, 0 V, which is the voltage of low voltage line 315, is written on the anode of the organic EL element 301 via the channel switch 307 and the driving TFT 302. Thus, at both ends of the storage capacitor 303, instead of the display voltage, VH (7 V) is written as it is.

Figure 27D:
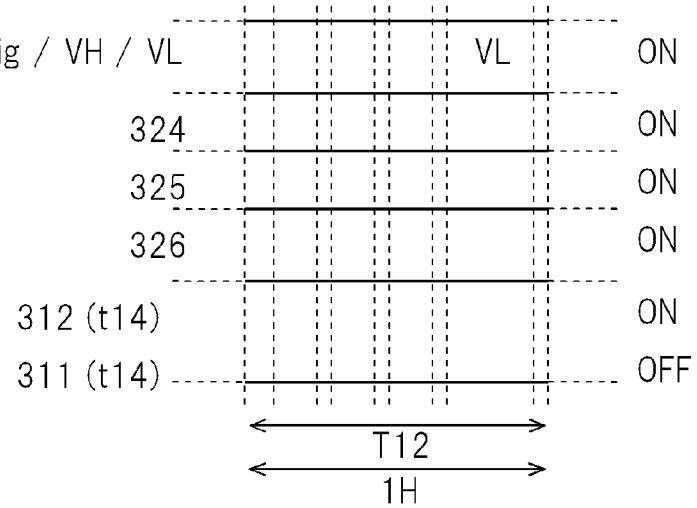
FIG. 27D is a diagram that shows a scanning timing of 1H period at timing t14 shown in FIG. 26.

FIG. 27D shows the scanning timing of 1H period at the timing t14. At the period T12, the voltage VL (0 V) is output from the driver IC 330 and is output to the signal line 313 by the switch-over switches 321, 322, and 323 that are simultaneously turned on by the gate scanning lines 324, 325, and 326.

At the timing t14, the gate scanning line 312 is turned on so that the gate switch 304 and the channel switch 307 of the pixel are turned on. Thus, since VL (0 V) is written on the gate of the driving TFT 302 from the gate switch 304 via the signal line 313, the driving TFT 302 is turned off. Thus, at both ends of the storage capacitor 303, VL (0 V) is written by the capacitor division with the inter-terminal capacitor of the organic EL element 301.

At this time, because 0 V is written on the anode of the organic EL element 301 in advance at the timing t13 and the inter-terminal capacitor of the organic EL element 301 is sufficiently large, VL (0 V) is written at both ends of the storage capacitor 303 nearly as it is. In addition, as mentioned above, it may be considered that the anode voltage of the organic EL element 301 maintains almost 0 V as it is until reaching the timing t11.

Next, from the viewpoint of the 1 frame period, a specific operation of the driving circuit will be described. During the period A (the light emitting period of the organic EL element 301) starting at the timing t12, the light emitting control lines 311 are turned on all together in all pixels 420 so that the light emitting control switch 306 is fixed in the on-state. The display voltage is written at both ends of the storage capacitor 303 in advance at the period D, which is a line-sequential signal wiring period, and the display voltage is applied between the gate and the source of the driving TFT 302, and thus, the driving TFT 302 drives the organic EL element 301 to emit light by the current corresponding to the display voltage.

Next, by the light emitting control line 311 is turned off all together, the light emitting control switch 306 is turned off. Then, the stress voltage VH (7 V) is written on the storage capacitor 303, which is provided between the gate and the source of the driving TFT 302, all together at the timing t13 and is held during period B.

Next, the relief voltage VL (0 V) is written on the storage capacitor 303, which is provided between the gates sources of the driving TFT 303, all together at the timing t14 and is held during period C. After that, returning to the initial timing t11, a new display voltage is written by the line-sequential scanning. The operation as described above is repeated for each 1 frame period.

According to the present embodiment, because the light emitting periods A of all pixels becomes the same in terms of the time, the moving picture can be especially smoothly displayed. Herein, in order to adjust the luminance of the whole screen without damaging the gamma characteristic of the image, it is desirable to control the length of the light emitting period A. In this case, particularly, when controlling the light emitting period to become short, an ideal pulse driving can be realized so that the quality of the moving picture display can be improved.

Further, according to the present embodiment, like the first embodiment, it is possible to solve the burning due to the characteristic change of the driving TFT 302 by applying the stress voltage. Furthermore, by providing the application period of the relief voltage, it is possible to restore the excessive characteristic change of the driving TFT 302 due to the stress voltage. Consequentially, it is possible to display an image at the stable luminance over a long period. In other words, it is possible to uniformly restore the characteristic change with respect to the greater characteristic change of the driving TFT 302 due to the stress voltage application, and it is possible to realize a display device which does not generate the burning or decline in luminance due to the driving circuit.

Twelfth Embodiment

Figure 28:
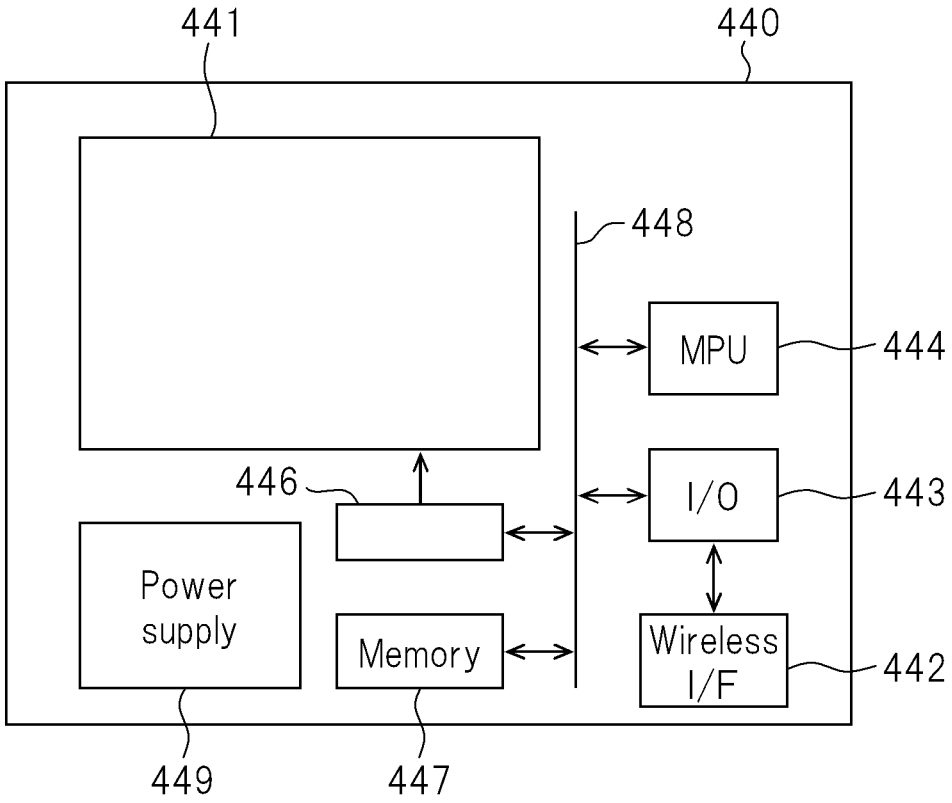
FIG. 28 is a diagram that shows a TV image display device in a twelfth embodiment of the present invention.
Figure 29:
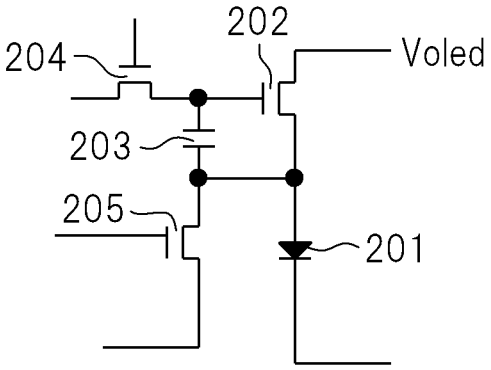
FIG. 29 is a diagram each pixel circuit of an organic EL display of the related art.
Figure 30:
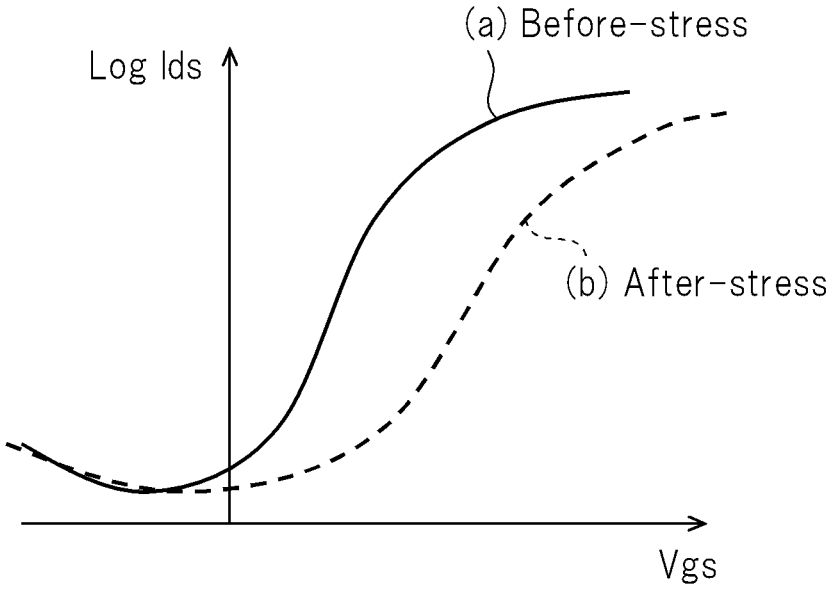
FIG. 30 is a diagram that shows a TFT characteristic before and after applying the voltage stress between the gate and the source of an amorphous Si-TFT of n channel.

FIG. 28 is a diagram that shows a TV image display device in a twelfth embodiment. As shown in FIG. 28, a TV image display device 440 has an organic EL display device 441. The organic EL display device 441 corresponds to, for example, the driving circuit including the pixel circuit described in the first embodiment.

As shown in FIG. 28, the TV image display device 440 has a power source 449, a wireless interface (I/F) circuit 442, and an I/O (Input/Output) circuit 443, a micro processor (MPU) 444, a display panel controller 446, and a frame memory 447 that are connected to the data bus 448, respectively.

The wireless interface (I/F) circuit 442 receives a ground wave digital signal or the like. Specifically, for example, the wireless interface (I/F) circuit 442 receives compressed image data or the like as wireless data from the outside. Furthermore, the wireless interface (I/F) circuit 442 outputs the compressed image data or the like to the data bus 448 via the I/O (Input/Output) circuit 443.

The display panel controller 446 is connected to the organic EL display 441. The power source 449 has, for example, a secondary battery, and supplies the electric power that drives the entire TV image display device 440.

Next, an operation of the twelfth embodiment will be described. Firstly, the wireless I/F circuit 442 obtains the compressed image data from the outside depending on the command, and transmits the image data to the micro processor 444 and the frame memory 447 via the I/O circuit 443.

The micro processor 444 receives the command operation from a user, drives the entire TV image display device 440 as necessary, and performs the decode, the signal processing or the information processing of the compressed image data. In addition, the image data subjected to the signal processing may be temporarily stored in the frame memory 447.

When the micro processor 444 issues the display command, according to the instruction, the image data are input to the organic EL display 441 from the frame memory 447 via the display panel controller 446, and the organic EL display 441 displays the input image data in real time.

At this time, the display panel controller 446 outputs and controls a predetermined timing pulse that is necessary for simultaneously displaying the image. In addition, regarding that the organic EL display 441 displays the input image data in real time using such a signal, it was described in the first embodiment, and thus the description thereof will be omitted.

According to the present embodiment, it is possible to realize the TV image display device 440, which does not generate the burning problem, displays a high quality image, and is produced at a greatly reduced cost.

Further, according to the present embodiment, like the first embodiment, it is possible to solve the burning due to the characteristic change of the driving TFT 302 by the application of the stress voltage. Furthermore, by providing the application period of the relief voltage, it is possible to restore the excessive characteristic change of the driving TFT 302 due to the stress voltage. Consequentially, it is possible to display an image at the stable luminance over a long period. In other words, it is possible to uniformly restore the characteristic change with respect to the greater characteristic change of the driving TFT 302 due to the stress voltage application, and it is possible to realize a display which does not generate the burning or decline in luminance due to the driving circuit.

In addition, in the present embodiment, the driving circuit is used as the organic EL display 441, which is described in the first embodiment, but it is needless to say that the pixel circuit or the driving circuit shown in other embodiments may be used. In this case, it is needless to say that a slight change is required in the timing pulse, which is output by the display panel controller 446.

In addition, the present invention is not limited to the first to twelfth embodiments but can be variously modified. For example, the present invention can be replaced with a configuration that is substantially the same as the configurations shown in the first to twelfth embodiments, a configuration that exhibits the same effect, or a configuration that can achieve the same object. For example, the configuration of the pixel or the like in each embodiment is an example thereof and can be replaced with a configuration which exhibits the same effect or a configuration which can achieve the same effect, without being limited thereto.

What is claimed is:

1. A display device comprising: a plurality of pixels respectively including; a light emitting element, a driving transistor configured to control driving current to the light emitting element, and a storage capacitor configured to be written voltage corresponding to a gradation value on and hold the voltage and configured to apply display voltage depending on the voltage corresponding to the gradation value between a gate and a source of the driving transistor; and a stress voltage application unit configured to apply a stress voltage having a voltage value outside a range of a value capable of taking the display voltage between the gate and the source of the driving transistor; wherein the stress voltage application unit applies one of a high voltage value, which has a voltage value higher than an upper limit value of the range of the value capable of taking the display voltage, and a low voltage value, which has a voltage value lower than a lower limit value of the range of the value capable of taking the display voltage, wherein the display device further comprises a relief voltage application unit configured to apply a relief voltage, and wherein the relief voltage has a voltage value lower than the high voltage value when applying the high voltage value, and has a voltage value higher than the low voltage value when applying the low voltage value.

2. The display device according to claim 1, wherein the relief voltage is a voltage value within the range of the value capable of taking the display voltage.

3. The display device according to claim 2, wherein the relief voltage has the lower limit value when the stress voltage application unit applies the voltage value higher than the upper limit value of the range of the value capable of taking the display voltage, and wherein the relief voltage has the upper limit value when the stress voltage application unit applies the voltage value lower than the lower limit value of the range of the value capable of taking the display voltage.

4. The display device according to claim 1, wherein the relief voltage application unit applies the relief voltage after the stress voltage application unit applies the stress voltage.

5. The display device according to claim 1, wherein the plurality of pixels are arranged in a matrix shape, wherein the display device further comprises; a display voltage generating unit configured to generate the display voltage, a signal line configured to input the display voltage to each of the plurality of pixels, and a power source line configured to supply each light emitting element with a light emitting electric power, wherein each of the plurality of pixels further has a pixel switch, wherein the driving transistor is an electric field effect transistor, wherein the storage capacitor is disposed between the gate and the source of the driving transistor, wherein one of the source and the drain of the driving transistor is connected to the power source line, and the other thereof is connected to the light emitting element, and wherein the gate of the driving transistor is connected to the signal line via the pixel switch.

6. The display device according to claim 5, wherein the display voltage, stress input voltage corresponding to the stress voltage, and relief input voltage that corresponds to the relief voltage are input to each of the plurality of pixels via the signal line.

7. The display device according to claim 6, wherein the display voltage generating unit further comprises a selection switch, and wherein the display voltage generating unit selectively outputs the display voltage, the stress input voltage, or the relief input voltage, via the selection switch.

8. The display device according to claim 6, wherein the display voltage generating unit further comprises a selection switch, and wherein the display voltage generating unit selectively outputs the stress input voltage or the relief input voltage, via the selection switch.

9. The display device according to claim 6, wherein the stress input voltage is input to each of the plurality of pixels via the power source line.

10. The display device according to claim 5, further comprising a stress voltage line provided in a vertical direction with respect to the signal line, wherein the stress input voltage and the relief input voltage are input to the plurality of pixels via the stress voltage line.

11. The display device according to claim 5, wherein each of the plurality of pixels further comprises a light emitting control switch, wherein a source terminal of electric field effect transistor is connected to the light emitting element, and a drain terminal thereof is connected to the power source line via the light emitting control switch, and wherein when applying the stress voltage to the storage capacitor, the light emitting control switch is fixed in an off-state.

12. The display device according to claim 5, wherein each of the plurality of pixels further comprises a light emitting control switch, wherein the source terminal of the electric field effect transistor is connected to the light emitting element, and the drain terminal thereof is connected to the power source line via the light emitting control switch, and wherein when applying the relief voltage to the storage capacitor, the light emitting control switch is fixed in an off-state.

13. The display device according to claim 5, wherein each of the plurality of pixels further comprises a light emitting control switch, wherein the source terminal of the electric field effect transistor is connected to the light emitting element, and the drain terminal thereof is connected to the power source line via the light emitting control switch, and wherein when applying the display voltage to the storage capacitor, the light emitting control switch is fixed in an off-state.

14. The display device according to claim 1, wherein each of the plurality of pixels further comprises a light emitting control switch, wherein the electric field effect transistor is a pMOS, wherein the source terminal of the electric field effect transistor is connected to the power source line, and the drain terminal thereof is connected to the light emitting element via the light emitting control switch, and wherein when applying the stress voltage to the storage capacitor, the light emitting control switch is fixed in an off-state.

15. The display device according to claim 1, wherein each of the plurality of pixels further comprises a light emitting control switch, wherein the electric field effect transistor is a pMOS, wherein the source terminal of the electric field effect transistor is connected to the power source line, and the drain terminal thereof is connected to the light emitting element via the light emitting control switch, and wherein when applying the relief voltage to the storage capacitor, the light emitting control switch is fixed in an off-state.

16. The display device according to claim 1, wherein each of the plurality of pixels further comprises a light emitting control switch, wherein the electric field effect transistor is a pMOS, wherein the source terminal of the electric field effect transistor is connected to the power source line, and the drain terminal thereof is connected to the light emitting element via the light emitting control switch, and wherein when applying the display voltage to the storage capacitor, the light emitting control switch is fixed in an off-state.

17. The display device according to claim 5, wherein each of the plurality of pixels further comprises;

a channel switch, and a low voltage wiring to which a predetermined constant voltage is applied, and wherein the drain terminal of the electric field effect transistor is connected to the low voltage wiring via the channel switch.

18. The display device according to claim 17, wherein the gate of the channel switch is commonly connected to the gate of the pixel switch, and wherein the plurality of pixels are controlled for each line of the plurality of pixels via the channel switch.

19. The display device according to claim 5, wherein each of the plurality of pixels further comprises;

a first channel switch, a second channel switch, and a low voltage wiring to which a predetermined constant voltage is applied, wherein the drain terminal of the electric field effect transistor is connected to the low voltage wiring via the first channel switch, and wherein the source terminal is connected to the low voltage wiring via the second channel switch.

20. The display device according to claim 19, wherein the gates of the first and second channel switches are commonly connected to the gate of the pixel switch, and wherein the plurality of pixels are controlled for each line of the plurality of pixels via the first and second channel switches.

21. The display device according to claim 17, wherein the low voltage wiring is commonly connected between adjacent pixels among the plurality of pixels.

22. The display device according to claim 17, wherein a terminal of the light emitting element, which is not connected to the electric field effect transistor, is commonly grounded between adjacent pixels among the plurality of pixels, and wherein the low voltage wiring is grounded in each of the plurality of pixels.

23. The display device according to claim 5, wherein the source terminal of the electric field effect transistor is connected to one end of the light emitting element, wherein the drain terminal of the electric field effect transistor is connected to the power source line, and wherein when the display voltage is applied to the storage capacitor, the voltage of the power source line is the same voltage as the voltage that is applied to the other end of the light emitting element.

24. The display device according to claim 5, wherein the source terminal of the electric field effect transistor is connected to one end of the light emitting element, wherein the drain terminal of the electric field effect transistor is connected to the power source line, and wherein when the stress voltage is applied to the storage capacitor, the voltage of the power source line is the same voltage as the voltage that is applied to the other end of the light emitting element.

25. The display device according to claim 5, wherein the source terminal of the electric field effect transistor is connected to one end of the light emitting element, wherein the drain terminal of the electric field effect transistor is connected to the power source line, and wherein when the relief voltage is applied to the storage capacitor, the voltage of the power source line is the same voltage as the voltage that is applied to the other end of the light emitting element.

26. The display device according to claim 5, wherein the display device collectively writes the stress voltage and the relief voltage on the storage capacitor in the plurality of pixels after writing the display voltage on the storage capacitor in the sequence of line in the plurality of pixels within a period of one frame.

27. The display device according to claim 1 further comprising:

a memory configured to store display data corresponding to the display voltage;

a display voltage generating unit configured to generate the display voltage from the display data; and a supply device configured to supply electric power for driving the display device.

* * * * *